US010399121B2

(12) United States Patent
Zhuang et al.

(10) Patent No.: US 10,399,121 B2
(45) Date of Patent: Sep. 3, 2019

(54) BIAS APPLICATION FOR CAPACITIVE MICROMACHINED ULTRASONIC TRANSDUCERS

(71) Applicant: Kolo Medical, Ltd., San Jose, CA (US)

(72) Inventors: Xuefeng Zhuang, San Jose, CA (US); Danhua Zhao, San Jose, CA (US); Yongli Huang, San Jose, CA (US)

(73) Assignee: Kolo Medical, Ltd., San Jose, CA (US)

( * ) Notice: Subject to any disclaimer, the term of this patent is extended or adjusted under 35 U.S.C. 154(b) by 85 days.

(21) Appl. No.: 15/262,037

(22) Filed: Sep. 12, 2016

(65) Prior Publication Data

US 2018/0071775 A1 Mar. 15, 2018

(51) Int. Cl.
*B06B 1/00* (2006.01)
*B06B 1/02* (2006.01)

(52) U.S. Cl.
CPC ..... *B06B 1/0292* (2013.01)

(58) Field of Classification Search
CPC ..... B06B 1/0292; B06B 1/0207
See application file for complete search history.

(56) References Cited

U.S. PATENT DOCUMENTS 7,564,172 B1 7/2009 Huang
7,612,635 B2 11/2009 Huang
7,759,839 B2 7/2010 Huang
7,764,003 B2 7/2010 Huang
7,779,696 B2 8/2010 Huang
7,880,565 B2 2/2011 Huang
7,956,510 B2 6/2011 Huang
8,004,373 B2 8/2011 Huang
8,008,105 B2 8/2011 Huang
8,018,301 B2 9/2011 Huang
8,105,941 B2 1/2012 Huang
8,120,229 B2 2/2012 Huang
8,247,945 B2 8/2012 Huang
8,345,513 B2 1/2013 Huang
8,363,514 B2 1/2013 Huang
8,429,808 B2 4/2013 Huang
8,483,014 B2 7/2013 Huang
8,526,271 B2 9/2013 Huang
8,559,274 B2 10/2013 Huang
8,767,514 B2 7/2014 Huang
8,796,901 B2 8/2014 Huang
8,815,653 B2 8/2014 Huang
8,926,517 B2 1/2015 Huang
(Continued)

*Primary Examiner* — Hovhannes Baghdasaryan
(74) *Attorney, Agent, or Firm* — Mattingly & Malur, PC

(57) ABSTRACT

In some examples, a capacitive micromachined ultrasonic transducer (CMUT) includes a first electrode and a second electrode. The CMUT may be connectable to a bias voltage supply for supplying a bias voltage, and a transmit and/or receive (TX/RX) circuit. In some cases, a first capacitor having a first electrode may be electrically connected to the first electrode of the CMUT, the first capacitor having a second electrode that may be electrically connected to the TX/RX circuit. Furthermore, a first resistor may include a first electrode electrically connected to the first electrode of the first capacitor and the first electrode of the CMUT. A second electrode of the first resistor may be electrically connected to at least one of: a ground or common return path, or the second electrode of the first capacitor.

27 Claims, 19 Drawing Sheets

(56) References Cited

U.S. PATENT DOCUMENTS

| | | | | |
|---|---|---|---|---|
| 8,952,595 | B2 | 2/2015 | Huang | |
| 8,975,984 | B2 | 3/2015 | Huang | |
| 9,132,450 | B2 | 9/2015 | Huang | |
| 9,221,077 | B2 | 12/2015 | Chen et al. | |
| 9,408,588 | B2 | 8/2016 | Huang | |
| 2003/0048698 | A1* | 3/2003 | Barnes | G01S 7/52038 367/181 |
| 2005/0219953 | A1* | 10/2005 | Bayram | B06B 1/0292 367/178 |

* cited by examiner

BIAS APPLICATION FOR CAPACITIVE MICROMACHINED ULTRASONIC TRANSDUCERS

TECHNICAL FIELD

Some examples herein relate to capacitive micromachined ultrasonic transducer (CMUTs), such as may be used for ultrasonic imaging or other applications.

BACKGROUND

Ultrasonic transducers are widely used in many different fields. Examples of ultrasonic transducers include lead zirconate titanate (PZT) transducers and capacitive micromachined ultrasonic transducers (CMUTs). A CMUT may include two electrodes arranged opposite to each other, with a transducing gap separating the two electrodes. One of the two electrodes is moveable toward and away from the other to realize an energy exchange between acoustic energy and electrical energy. For example, the CMUT may be activated by electrical signals to cause movement of the moveable electrode for generating acoustic energy. Further, impingement of acoustic energy on the moveable electrode of the CMUT may cause generation of electric signals.

In some cases, a CMUT may employ an additional bias voltage, such as when receiving acoustic echo signals for imaging purposes. For instance, the application of a bias voltage may be used to change the frequency or other transducing properties of the CMUT. As one example, the bias voltage may be a DC voltage that remains constant during imaging or other operations. Conventionally, the bias voltage may be applied by connecting a bias voltage source directly to one of the electrodes of the CMUT. However, if the CMUT fails, such as by shorting out across the transducing gap, the bias source or other circuits in the system may be damaged.

SUMMARY

Some implementations herein include techniques and arrangements for applying a bias voltage to a CMUT. For example, the CMUT may include a first electrode and a second electrode. The CMUT may be connectable to a bias voltage supply able to supply a bias voltage, and a transmit and/or receive (TX/RX) circuit. One or more protective components may be included between the CMUT and the TX/RX circuit and/or between the CMUT and the bias voltage supply. As one example, a first capacitor may have a first electrode that may be electrically connected to the first electrode of the CMUT. The first capacitor may have a second electrode that may be electrically connected to the TX/RX circuit. Furthermore, a first resistor may include a first electrode electrically connected to the first electrode of the first capacitor and the first electrode of the CMUT. A second electrode of the first resistor may be electrically connected to a ground or common return path, and/or the second electrode of the first capacitor.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION

Figure 1:
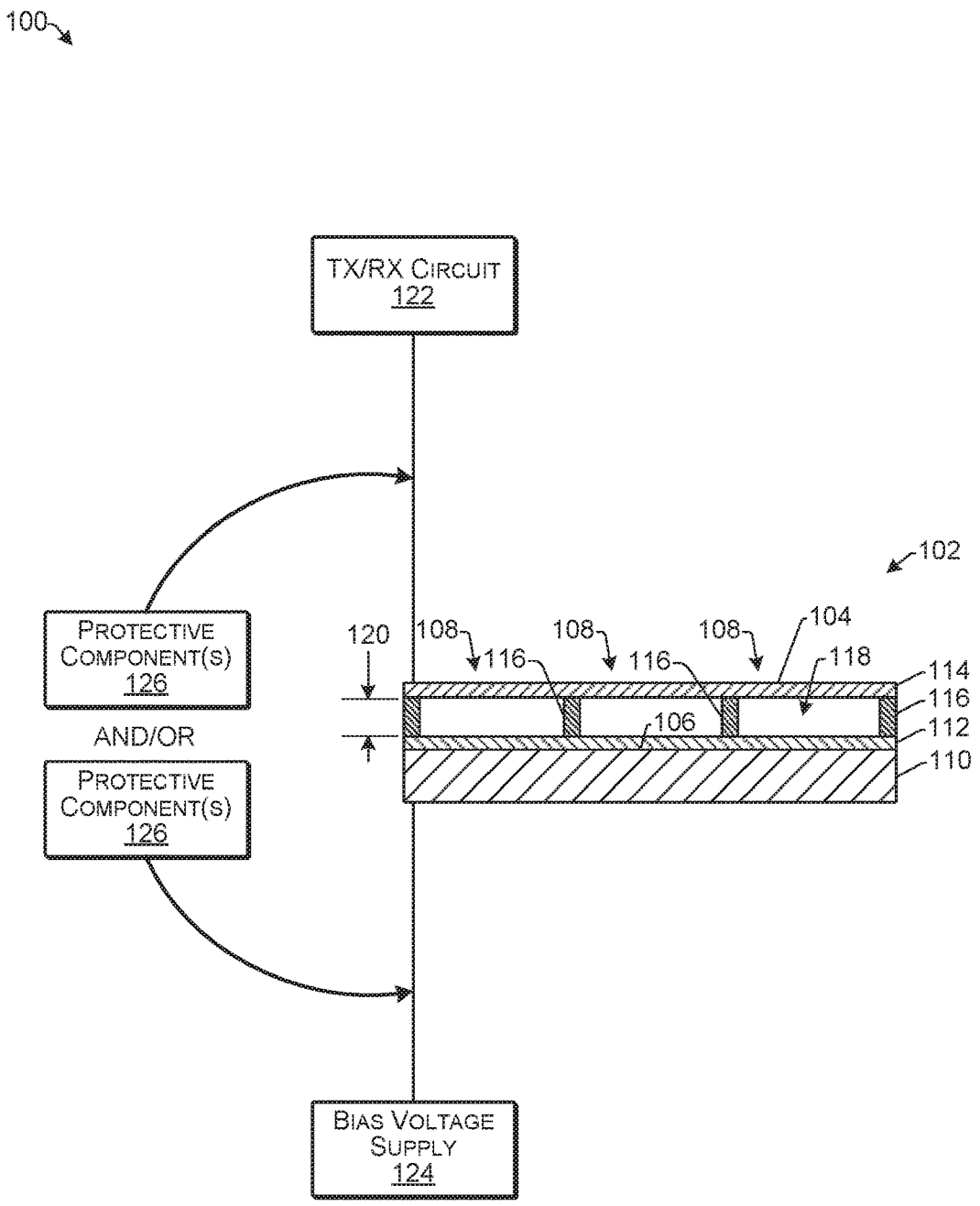
FIG. 1 illustrates an example system for applying a bias voltage to a CMUT according to some implementations.

Some implementations include techniques and arrangements for applying a bias voltage to a CMUT. Examples of CMUTs to which the bias voltage may be applied include a CMUT element or sub-element in a CMUT array, one or more CMUT cells in a CMUT system, and/or any other type of CMUT configuration. The CMUTs herein may include a first electrode opposed to a second electrode, with a transducing gap between the two electrodes. At least one of the electrodes is able to move toward and away from the other electrode for generating and/or receiving ultrasonic energy. A transmit and/or receive (TX/RX) circuit may electrically connect directly or indirectly to one of the electrodes, and a bias voltage supply may electrically connect directly or indirectly to the other electrode (i.e., through or not through any other electronic components).

In the implementations herein, one or more protective components may be included in a circuit between at least one of the electrodes and at least one of the TX/RX circuit or the bias voltage supply. As one example, a first capacitor may be disposed between the CMUT and the TX/RX circuit to prevent the bias voltage from being directly applied to the TX/RX circuit in the case that the CMUT is damaged. However, if the CMUT is not damaged, the bias voltage is not applied on any circuit portions between the CMUT and the TX/RX circuit, including the first capacitor. The capacitance of the first capacitor may be selected to have minimum impact on the TX/RX signal passing through the first capacitor. For instance, the capacitance of the first capacitor may be larger than the capacitance of the CMUT. In some cases, the capacitance of the first capacitor may be about 5 times, or more, larger than the capacitance of the CMUT.

Additionally, in some examples, a first resistor may be included for setting a desired DC potential, e.g., with a ground (GND) or common return path (COM), between the CMUT and the first capacitor. The GND may be an earth ground, a chassis ground, or a signal ground. The resistance of the first resistor may be selected to be larger than the impedance of the CMUT in the operation frequency range of the CMUT. As one example, the resistance of the first resistor may be selected to be about 5 times, or more, larger than the impedance of the CMUT in the operating frequency range of the CMUT. The operating frequency range may be equivalent to a transducer bandwidth covering all useful signals (e.g. a −20 dB bandwidth, a −40 dB bandwidth, and so forth).

Furthermore, in some examples, a second capacitor may be disposed between the second electrode of the CMUT and the GND/COM to reduce noise of the bias voltage supply. For instance, the capacitance of the second capacitance may be larger than the capacitance of the CMUT. As an example, the capacitance of the second capacitor may be about 10 times, or more, larger than the capacitance of the CMUT.

Additionally, in some cases, a second resistor may be disposed between the second electrode of the CMUT and the bias voltage supply to protect the bias voltage supply in case the CMUT is damaged. As an example, the resistance of the second resistor may be smaller than the resistance of the first resistor. For instance, the resistance of the second resistor may be about 1/10 to 1/3 the resistance of the first resistor.

In some examples, a third capacitor may be connected between the first capacitor and the TX/RX circuit to further protect the TX/RX circuit. Further, a third resistor may be connected between the electrode of the third capacitor connecting to the first capacitor and the GND/COM. The capacitance of the third capacitor may be similar to that of the first capacitor and the resistance of the third resistor may be similar to that of the first resistor.

In some examples, multiple CMUTs and/or multiple elements in a CMUT array may share a common bias voltage supply. In this situation, the multiple CMUTs or CMUT elements may share the same second capacitor and, in some cases, may share the same second resistor. In addition, each CMUT or CMUT element may be connected to an individual TX/RX circuit (e.g., an individual TX/RX channel, in a CMUT system). Each CMUT or CMUT element may include a respective first capacitor and, in some examples, a respective third capacitor. Further, each CMUT or CMUT element may include a respective first resistor, and, in some examples, a respective third resistor.

For discussion purposes, some example implementations are described in the environment of ultrasound imaging. However, implementations herein are not limited to the particular examples provided, and may be extended to other applications, other systems, other environments for use, other array configurations, and so forth, as will be apparent to those of skill in the art in light of the disclosure herein.

FIG. 1 illustrates an example CMUT system 100 according to some implementations. FIG. 1 includes a cross-sectional representation of a CMUT 102, which may have any transducer shape in some implementations. For example, the CMUT 102 may be part of a larger CMUT, part of a CMUT element or sub-element in a CMUT array, or part of any other type of CMUT configuration. In this example, the CMUT 102 includes a first (e.g., upper) electrode 104 and a second (e.g., bottom) electrode 106. The first electrode 104 and the second electrode 106 may be flat or otherwise planar in this example, but are not limited to such in other examples. Furthermore, while one possible CMUT structure is described in this example, implementations herein are not limited to the illustrated structure, and may apply to any CMUT structure having two or more electrodes, in which at least one of the electrodes is moveable with respect to another, including CMUTs with embedded springs, or the like.

In the illustrated example, a plurality of CMUT cells 108 are formed on a substrate 110. In some cases, the substrate 110 may be formed of a conductive material and may serve as the second electrode 106 for the CMUT cells 108. In other examples, such as in the case that the substrate 110 is formed of a nonconductive material, a layer of conductive material may be deposited onto an upper surface of the substrate 110 to serve as the second electrode 106, such as prior to deposition of an optional insulation layer 112, which may be disposed on an upper surface of the second electrode 106.

An elastic membrane 114 may be disposed over the substrate 110 and may be supported by a plurality of sidewalls 116 to provide a plurality of cavities 118 corresponding to the individual CMUT cells 108, respectively, e.g., one cavity 118 per CMUT cell 108. In some examples, the membrane 114 may have a uniform thickness over the cavities 118; however, in other examples, the thickness or other properties of the membrane 114 may vary, which may vary the frequency and/or other properties of the CMUT cells 108. The membrane 114 may be made of an elastic material to enable the membrane 114 to move toward and away from the substrate 110 within a transducing gap 120 provided by the cavities 118. The membrane 114 may be made of a single layer or multiple layers, and at least one layer may be of a conductive material to enable the membrane 114 to serve as the first electrode 104.

Factors that may affect the resonant frequency of the CMUT cells 108 include the size of the cavities 118, which corresponds to the membrane area over each cavity, and membrane stiffness, which may at least partially correspond to the membrane thickness over each cavity 118, membrane thickness and the membrane material. In addition, the structure of the CMUT cells 108 in different regions of the CMUT 102 may be configured differently. For example, the center frequency (or first resonant frequency) of the CMUT cells 108 in different regions may be designed differently from the CMUT cells 108 in the other regions. In some cases, the substrate 110 may be bonded to or otherwise attached to another substrate (e.g., an IC wafer/chip, PCB board, glass wafer/chip, acoustic backing material etc.) that is not shown in this example.

A TX/RX circuit 122 may be a front-end circuit including a single channel or a plurality of channels (as described additionally below) connected to the CMUT or the CMUT array 102 for causing the CMUT 102 to transmit ultrasonic energy and/or to receive an electric signal representative of ultrasonic energy that impinges on the CMUT 102. For example, the membrane 114, as the first electrode 104, may be deformed by applying an AC voltage between the first electrode 104 and the second electrode 106 to cause transmission (TX) of ultrasonic energy. Additionally, the membrane 114 may be deformed by an impinging ultrasound wave during reception (RX) of ultrasonic energy. Thus, the membrane 114 is able to move back and forth within the transducing gap 120 in response to an electrical signal when producing ultrasonic energy, or in response to receiving ultrasonic energy.

Figure 14:
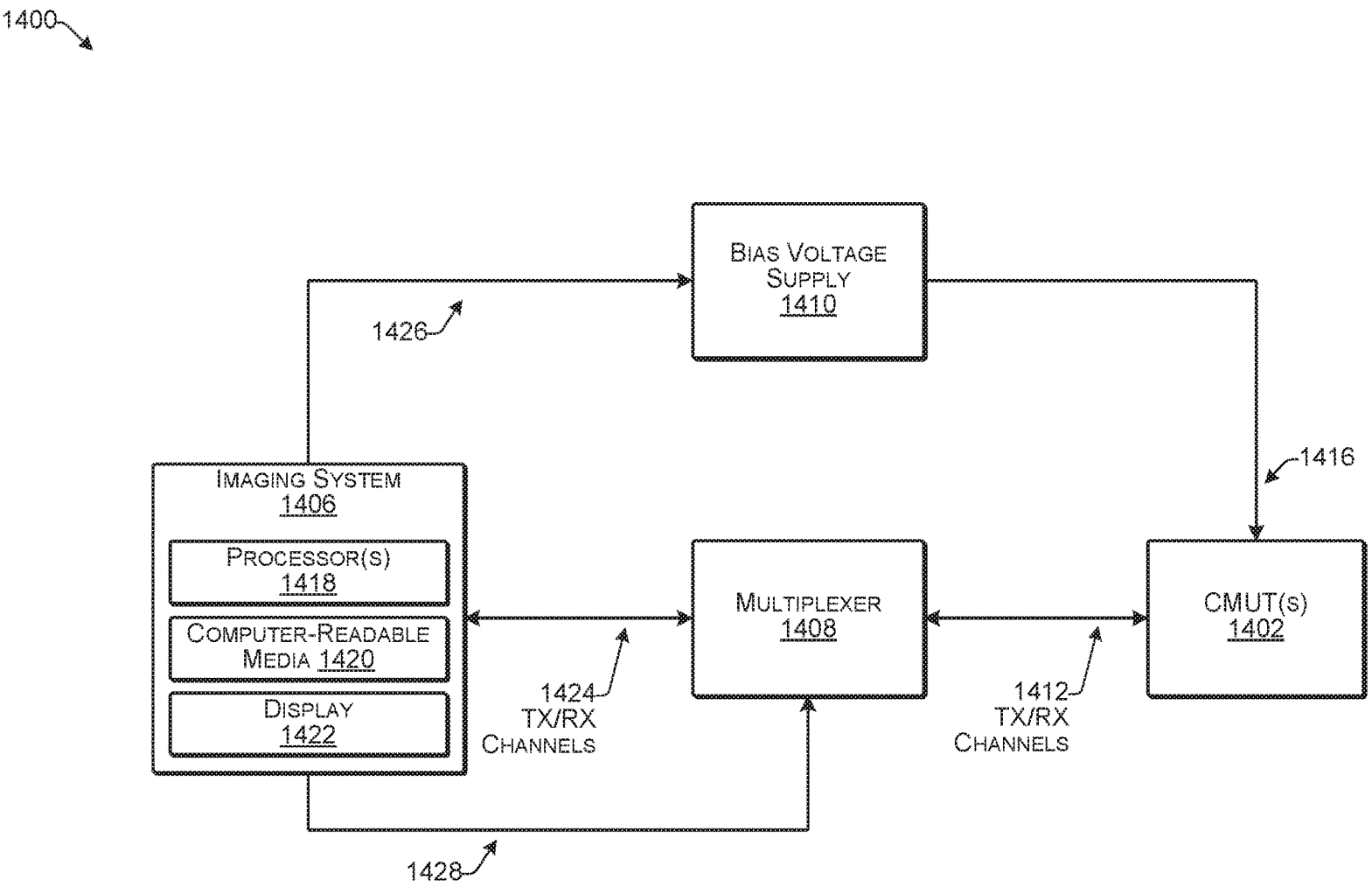
FIG. 14 is a block diagram illustrating an example configuration of an ultrasound system including one or more CMUTS according to some implementations.

The TX/RX circuit 122 may apply an AC (alternating current) electric signal on the CMUT 102 to cause the CMUT 102 to generate an acoustic wave for a transmission operation. Additionally, for a receive operation, the TX/RX circuit 122 may receive, from the CMUT 102, an electrical signal that is converted from an acoustic signal by the CMUT 102. The TX/RX circuit 122 may be a front-end circuit in the system 100 that interfaces with the CMUT 102. In the case that the CMUT 102 is part of a CMUT array, the TX/RX circuit 122 may include multiple TX/RX channels and each TX/RX channel may have its own TX/RX front-end circuit that interfaces with a corresponding CMUT element of the CMUT array. FIG. 14 provides an example of a system with TX/RX circuits/channels 122. Other types of TX/RX circuits are known in the art.

A bias voltage supply 124 may be connected to the CMUT 102 for applying a bias voltage to the CMUT 102. The bias voltage (DC or AC voltage) may be applied between the electrodes 104 and 106, such as during receive operations. In some cases, if the bias source is an AC voltage, the frequency may be beyond the operating frequency range of the CMUT so that the bias voltage itself does not cause the CMUT to generate any meaningful acoustic signal. In some cases, the bias voltage supply may include a DC-to-DC converter and one or more bias voltage generators. Examples of bias voltage supplies are discussed additionally below, e.g., with respect to FIGS. 15-18.

In some examples, the bias voltage may be applied to the CMUT 102 during receive operations. Additionally, or alternatively, the bias voltage may be applied to the CMUT 102 during transmission operations. By applying a bias voltage to the CMUT cells 108, an initial electrostatic force loading may be placed on the membrane 114, which may change the resonant frequency or other properties of the respective CMUT cells 108. In some cases, at least one CMUT performance parameter (e.g., transducing efficiency, frequency response, or the like) may be made different by controlling the bias voltage applied to the CMUT 102. For instance, the bias voltage may be selectively applied to the CMUT 102 to turn on and off a function of the transducer or change the performance parameter(s) of the CMUT 102.

In some cases, different bias voltages may be applied to different regions of the CMUT 102 (e.g., different ones of the CMUT cells 108) to impart different ultrasound reception and/or transmission performance parameters to the different regions. Furthermore, if the bias voltage in a region of the CMUT 102 is changed with time, then the CMUT performance parameter(s) in the region may also change with time accordingly. As one example, such as in the case that the CMUT 102 is included in a CMUT array, by controlling the bias voltages in different regions of the CMUT 102, the effective aperture or/and apodization of the CMUT 102 may be controlled and changed accordingly.

In the example of FIG. 1, the TX/RX circuit 122 may be connected to a first electrode (e.g., 104) of the CMUT 102 and the bias voltage supply 124 may be connected to a second electrode (e.g., 106) of the CMUT 102. To prevent damage to the TX/RX circuit 122 and/or to the bias voltage supply 124, one or more protective components 126 may be included between the CMUT 102 and the TX/RX circuit 122, and/or between the CMUT 102 and the bias voltage supply 124. As discussed additionally below with respect to FIGS. 2-12, various electronic components 126 may be included for protecting the TX/RX circuit 122 and/or the bias voltage supply 124, such as in the case that the CMUT 102 is damaged, malfunctions, shorts out, or the like. Additionally, in some examples, the orientation of the CMUT electrodes 104 and 106 may be reversed with respect to the electrical connections to the TX/RX circuit 122 and the bias voltage supply 124.

Figure 2:
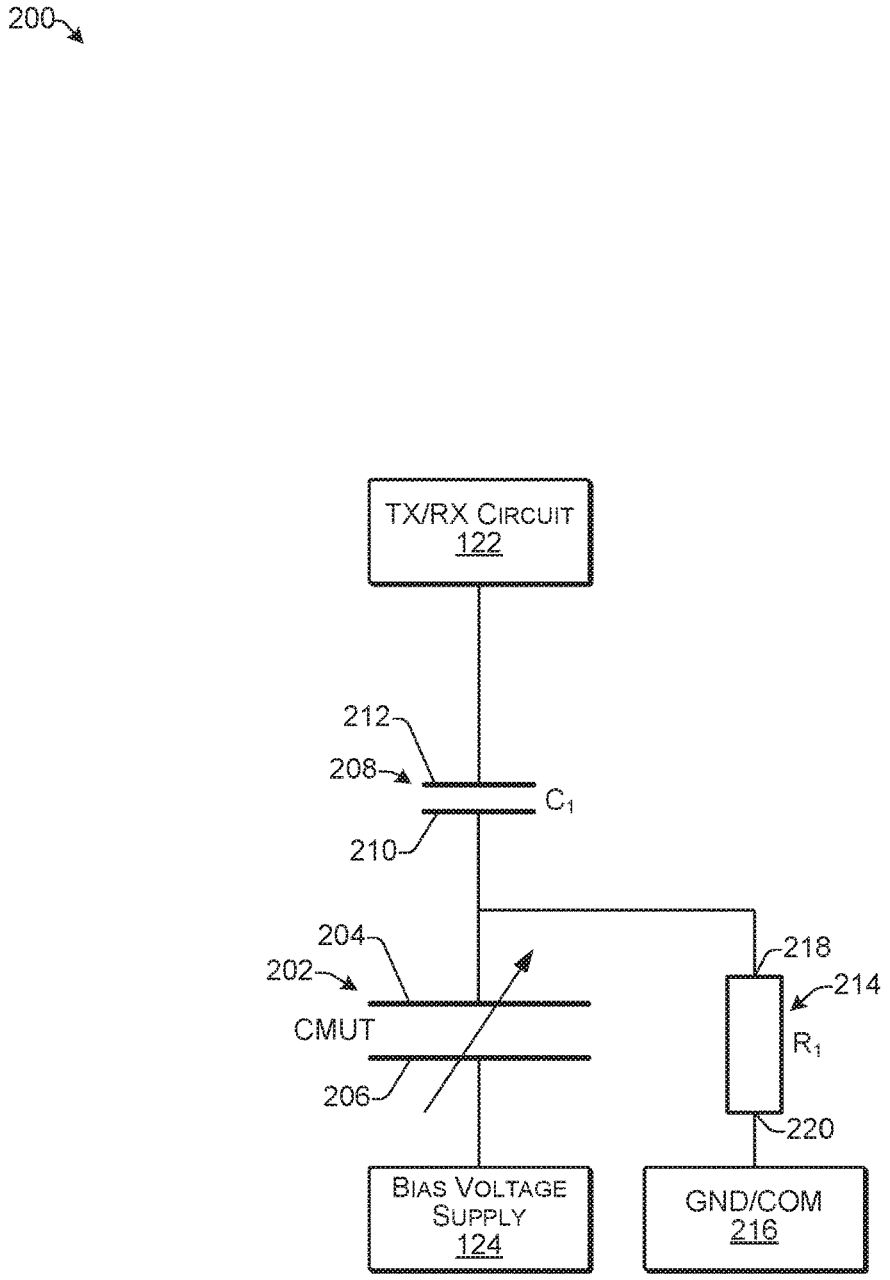
FIG. 2 illustrates an example circuit for applying a bias voltage to a CMUT according to some implementations.

FIG. 2 illustrates an example circuit 200 for applying a bias voltage according to some implementations. A CMUT 202 may be represented in the circuit 200 as a variable capacitor with a first electrode 204 and a second electrode 206. In some examples, the CMUT 202 may correspond to the CMUT 102 having the first electrode 104 and the second electrode 106 discussed above, or other CMUT configurations. For instance, the CMUT 202 may include a plurality of CMUT cells, may be an element or sub-element in a CMUT array, and/or any other desired CMUT structural configuration. Further, the circuit 200 may include the TX/RX circuit 122 and the bias voltage supply 124. Additionally, in some examples, the orientation of the CMUT electrodes 204 and 206 may be reversed with respect to the electrical connections to the TX/RX circuit 122 and the bias voltage supply 124.

A first capacitor C1 208 is electrically connected between the TX/RX circuit 122 and the CMUT 202 and may prevent the bias voltage from being directly applied to the TX/RX circuit 122, such as in the case that a short occurs between the first electrode 204 and the second electrode 206. In this example, the TX/RX circuit 122 may connect with the first electrode 204 of the CMUT 202 through the first capacitor C1 208. A first electrode 210 of the first capacitor C1 208 connects to the first electrode 204 of the CMUT 202 and a second electrode 212 of the first capacitor C1 208 connects to the TX/RX circuit 122. The bias voltage supply 124 (e.g. DC or AC voltage) may be connected to the second electrode 206 of the CMUT 202.

Additionally, a first resistor R1 214 is connected between the first electrode 204 of the CMUT 202, the first electrode 210 of the first capacitor C1, and a GND/COM 216 (e.g., an earth ground, a chassis ground, an AC signal ground, a common return path, or the like). A first electrode 218 of the first resistor R1 214 connects to the first electrode 204 of the CMUT and the first electrode 210 of the first capacitor 208. A second electrode 220 of the first resistor 214 connects to the GND/COM 216.

Both the resistance of the resistor R1 214 and the capacitance of the capacitor C1 208 are selected to have minimal impact on the TX/RX signal. The capacitance of the first capacitor C1 208 may be larger than the capacitance of the CMUT 202. In some examples, the capacitance of the first capacitor C1 208 may be 5 times, or more, larger than the capacitance of the CMUT 202. In some examples, the capacitance of the first capacitor C1 208 may be 5 times, 10 times, 100 times, 1000 times, or more, larger than the capacitance of the CMUT 202. For instance, the capacitance of the CMUT 202 may depend at least in part on the size of the CMUT, the size of the CMUT transducing gap, and the like. As an example, the upper range of the capacitance of the first capacitor C1 208 may depend at least partially on the component availability by considering the voltage rating and packaging size in real-world applications. As one non-limiting example, the capacitance of a CMUT in a medical ultrasound probe may be about 5 pF to 100 pF, while the capacitance of the first capacitor may be about 1 nF to 100 nF.

Furthermore, the resistance of the first resistor R1 214 may be selected to be larger than the impedance of the CMUT 202 in the operation frequency range of the CMUT 202. In some cases, the resistance of the first resistor R1 214 may be selected to be 5 times, or more, larger than the impedance of the CMUT 202 in the operating frequency range of the CMUT. In some examples, the resistance of the first resistor R1 214 may be selected to be 5 times, 10 times, 100 times, 1000 times, or more, larger than the impedance of the CMUT 202, in the operating frequency range of the CMUT. The operating frequency range of the CMUT 202 may be equivalent to a transducer bandwidth covering useful signals (e.g., a −20 dB bandwidth, a −40 dB bandwidth, and so forth). Furthermore, the insulation layer of the CMUT 202 (corresponding, e.g., to the insulation layer 112 of CMUT 102) may have a finite resistance, so the upper limit for the first resistor R1 214 may be 5 to 10 times lower than the resistance of the insulation layer in CMUT 202.

In the illustrated example of FIG. 2, under normal operation, the bias voltage supply 124 is separated from the TX/RX circuit 122 by the CMUT 202, so that there is normally no bias voltage applied to the TX/RX circuit 122 or to any components between the CMUT 202 and the TX/RX circuit 122. In addition, when the bias voltage is applied, if there is a short in the CMUT 202, the bias voltage may be applied on the first capacitor C1 208, rather than across the first capacitor C1 208 to be applied on the TX/RX circuit 122. Furthermore, the resistor R1 214 prevents the bias from shorting directly to the GND/COM 216 so that the bias voltage supply 124 can maintain the bias voltage (or otherwise properly function) even when there is a short in the CMUT 202. For example, when multiple CMUTs are sharing the same bias voltage supply 124, if there is a short in one CMUT, the bias voltage may still be maintained on the other CMUTs that share the bias voltage supply. Thus, the first capacitor C1 208 and the first resistor R1 214 combine to protect the TX/RX circuit 122 and keep the bias circuit properly functioning when there is a short the CMUT 202.

Figure 3:
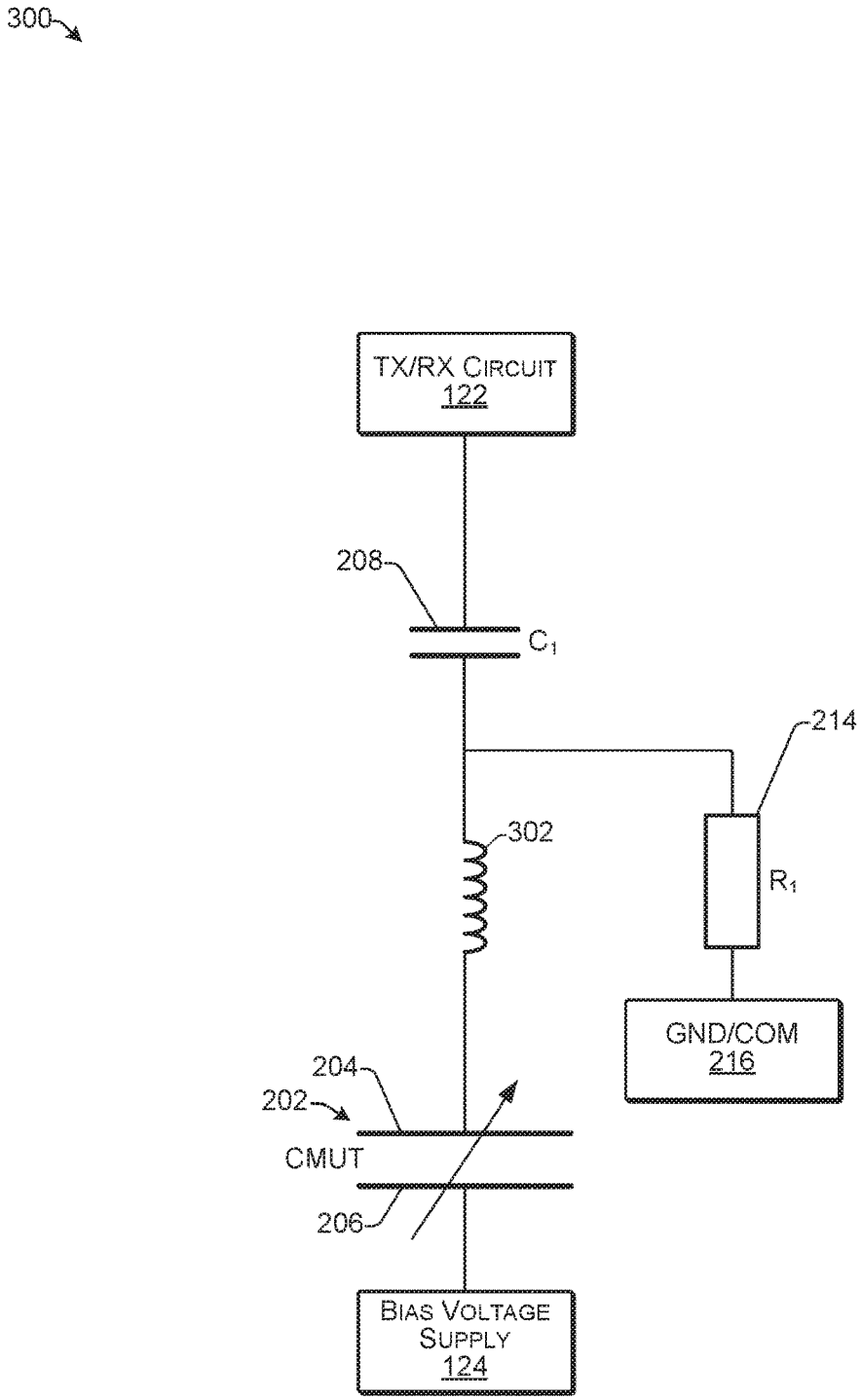
FIG. 3 illustrates an example circuit for applying a bias voltage to a CMUT according to some implementations.

FIG. 3 illustrates an example circuit 300 for applying a bias voltage to a CMUT according to some implementations. In this example, the circuit 300 includes the first capacitor C1 208 and the first resistor R1 214 connected to the GND/COM 216. Further, the circuit 300 includes an inductor 302 that may be included anywhere along the signal path between the TX/RX circuit 122 and the CMUT 202. For instance, the inductor 302 may be used to tune the performance of the CMUT 202 by matching the impedance difference between the CMUT 202 and an interface circuit, which may include a cable, other conductors, and/or the TX/RX circuit (not shown in FIG. 3).

As one example, the impedance of the CMUT 202 in its operation frequency range may be much higher than the impedance of the cable, other conductors, and/or the TX/RX circuit. Thus, the inductor 302 may be used to tune the impedance of the CMUT 202 to match better with the impedance of the cable or other conductors to improve the efficiency of the system. For example, the inductance of the inductor may be chosen so that the resonant frequency of the inductor and the CMUT (e.g., modeled as a capacitor) is in a range from 0.1 Fc to 5 Fc (where Fc is the center frequency of the CMUT). In some cases, the inductor 302 may be placed close to the CMUT 202. For example, the inductor 302 may be connected between the CMUT 202 and the first capacitor 208. The inductor 302 can be optionally added in the line between the TX/RX circuit and the CMUT in any of the configurations shown in FIGS. 1-13.

Figure 4:
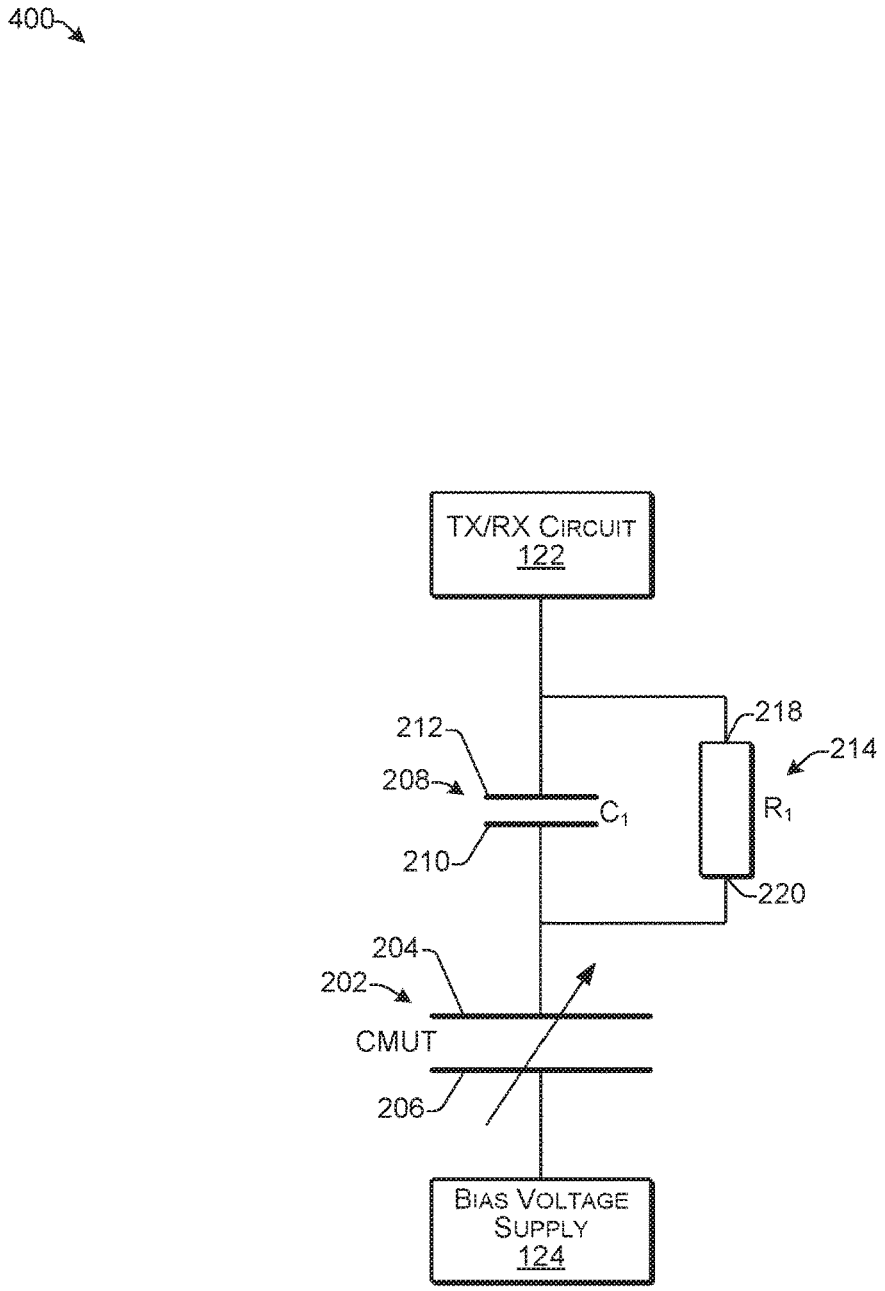
FIG. 4 illustrates an example circuit for applying a bias voltage to a CMUT according to some implementations.

FIG. 4 illustrates an example circuit 400 for applying a bias voltage to a CMUT according to some implementations. In this example, the circuit 400 includes the first capacitor C1 208 and the first resistor R1 214. However, the first resistor R1 214 is connected in parallel with the first capacitor 208, rather than being connected to a ground. Accordingly, the first electrode 210 of the first capacitor 208 connects to the second electrode 220 of the first resistor 214, and the second electrode 212 of the first capacitor 208 connects to the first electrode 218 of the first resistor 214. In the case that there is a short in the CMUT 202, the bias voltage may be applied on both the first resistor and the first capacitor, instead of the TX/RX circuit 122. In addition, the DC voltage potential at the first electrode 210 of the first capacitor C1 208 may be defined based on the DC potential of the second electrode 212, which may be defined by the TX/RX circuit.

Figure 5:
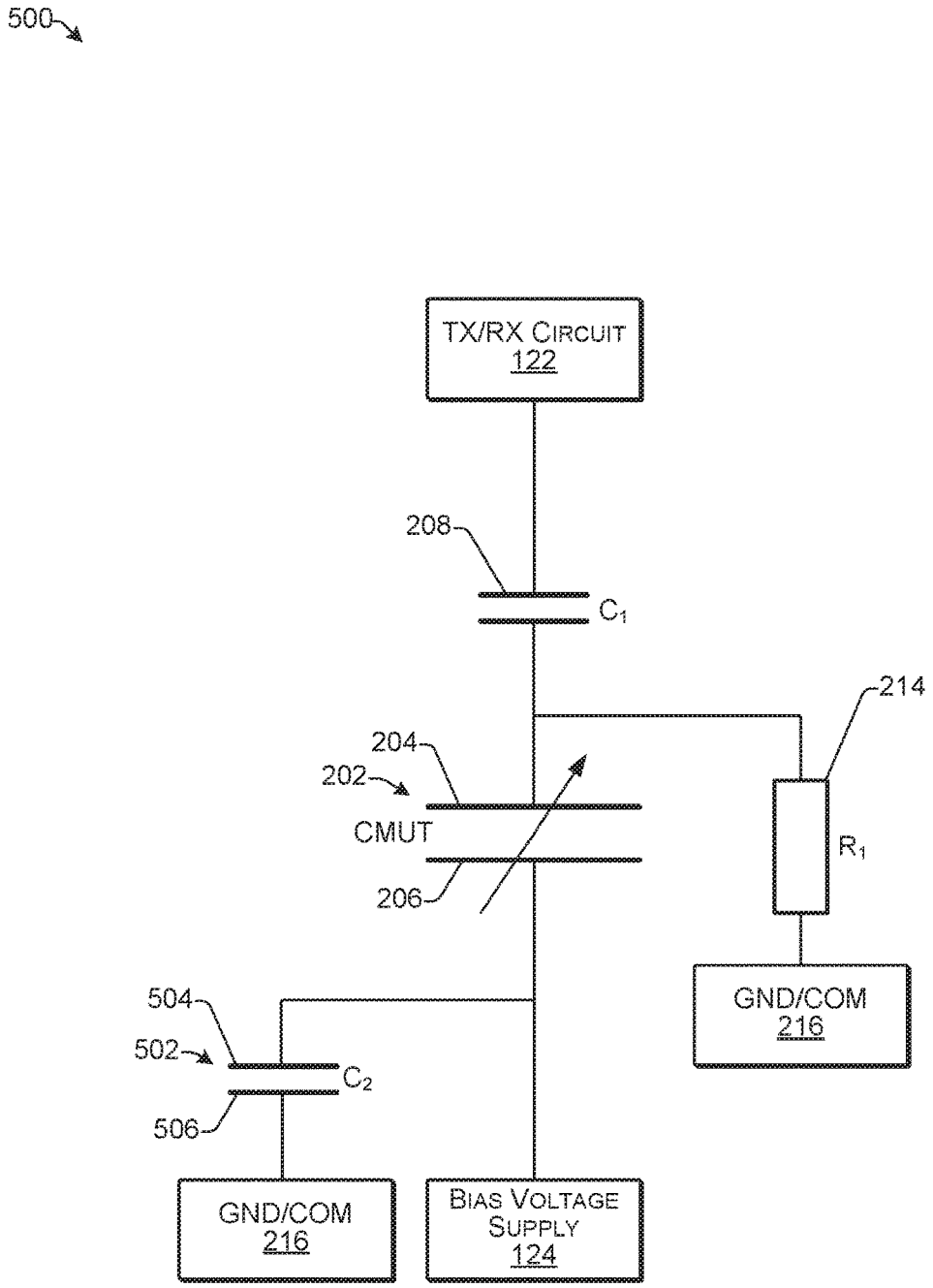
FIG. 5 illustrates an example circuit for applying a bias voltage to a CMUT according to some implementations.

FIG. 5 illustrates an example circuit 500 for applying a bias voltage to a CMUT according to some implementations. In this example, the circuit 500 includes the first capacitor C1 208 and the first resistor R1 214 connected to the GND/COM 216. In addition, the circuit 500 includes a second capacitor C2 502. A first electrode 504 of the second capacitor 502 connects to the second electrode 206 of the CMUT 202 and a second electrode 506 of the second capacitor C2 502 connects to the GND 216. The capacitance of the second capacitor 502 may enhance the noise performance of the bias voltage by reducing noise caused by the bias voltage supply 124. For instance, the capacitance of the second capacitor C2 502 may be larger than the capacitance of the CMUT 202. In some examples, the capacitance of the first capacitor C2 502 may be 5 times, or more, larger than the capacitance of the CMUT 202. In some examples, the capacitance of the first capacitor C2 502 may be 5 times, 10 times, 100 times, 1000 times, or more, larger than the capacitance of the CMUT 202.

Figure 6:
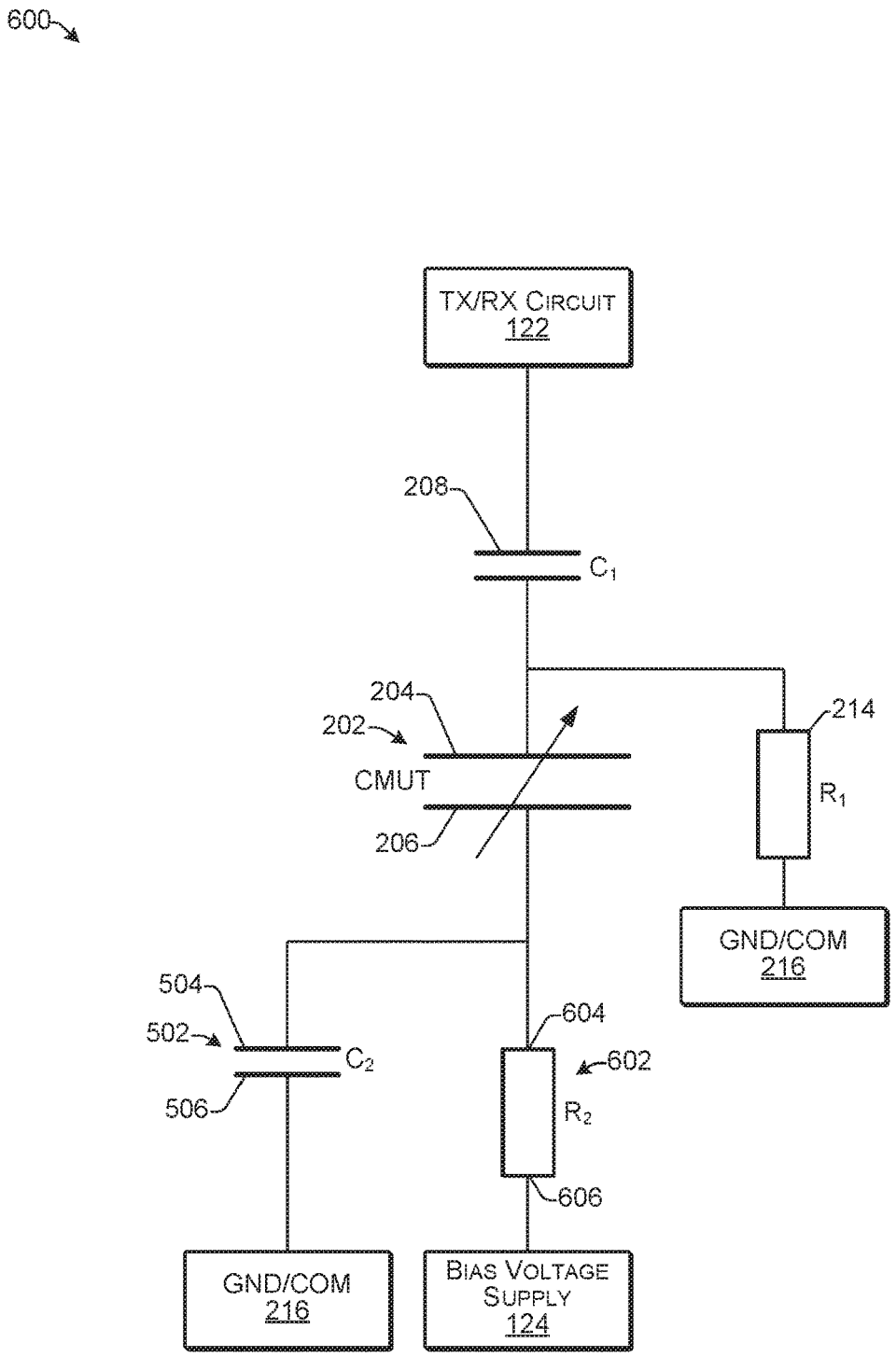
FIG. 6 illustrates an example circuit for applying a bias voltage to a CMUT according to some implementations.

FIG. 6 illustrates an example circuit 600 for applying a bias voltage to a CMUT according to some implementations. In this example, the circuit 600 includes the first capacitor C1 208 and the first resistor R1 214 connected to the GND/COM 216. In addition, the circuit 600 includes the second capacitor 502 connected to the second electrode 206 of the CMUT 202 and the GND 216. Furthermore, the circuit 600 includes a second resistor R2 602 having a first electrode 604 connected to the first electrode 504 of the second capacitor 502 and the second electrode 206 of the CMUT 202. A second electrode 606 of the second resistor R2 602 may be connected to the bias voltage supply 124. In some examples, the second resistor R2 602 is optional.

The second resistor R2 602 may protect the bias voltage supply 124 from a large AC signal from the TX/RX circuit 122 if the CMUT 202 is damaged, shorts out, or the like. For instance, the resistance of the second resistor R2 602 may be smaller than the resistance of the first resistor R1 214. For example, the resistance of the second resistor R2 602 may be 1/10 to 1/3 the resistance of the first resistor R1 214. Additionally, in some cases, the impedance of the second resistor R2 602 may be larger than the impedance of the second capacitor C2 502 in the CMUT operating frequency range, such as 5 times, or more, larger than the impedance of the second capacitor C2 502 in the CMUT operating frequency range. As an example, the impedance of the second resistor R2 602 may be 5 times, 10 times, 100 times, or more, larger than the impedance of the second capacitor C2 502 in the CMUT operating frequency range.

Figure 7:
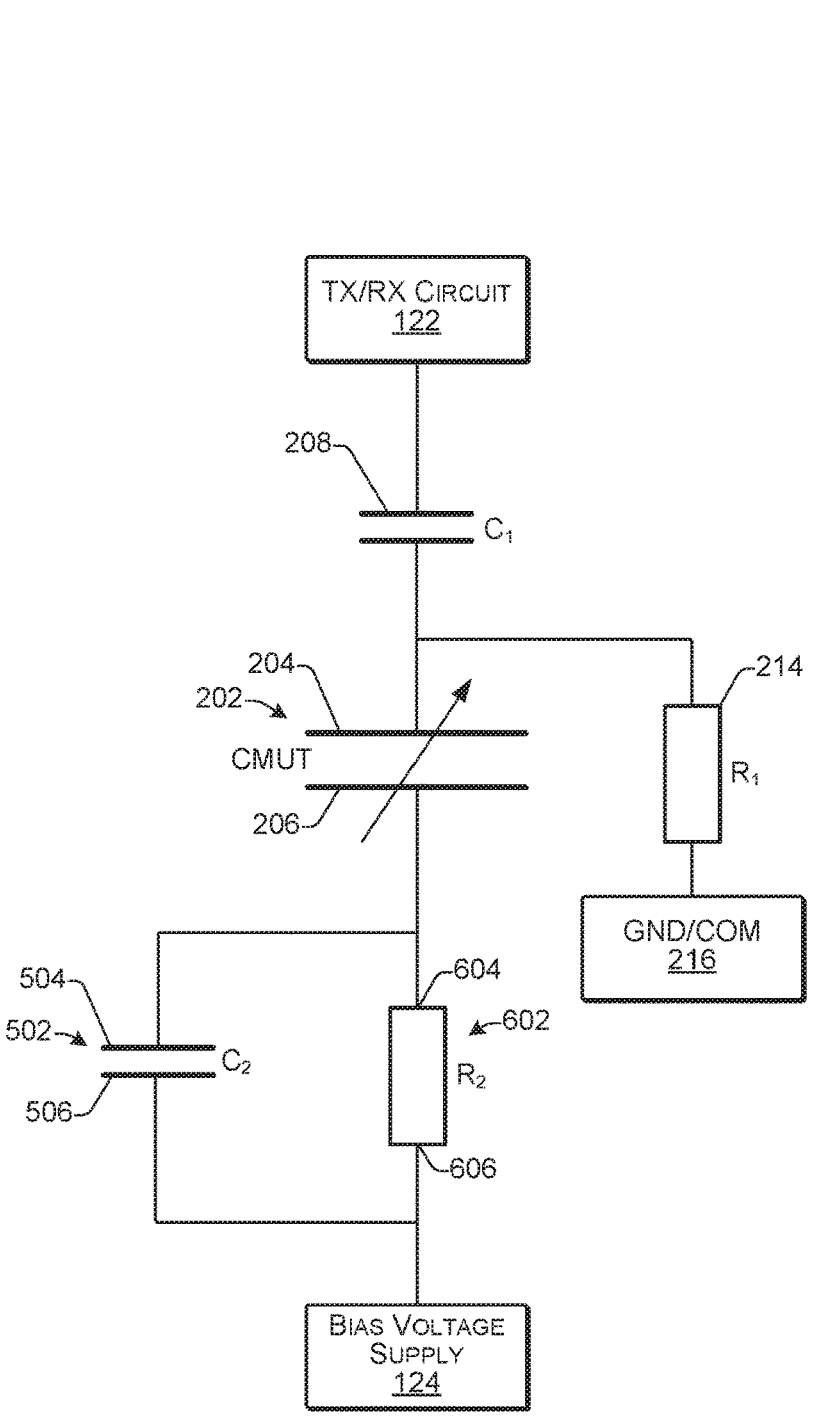
FIG. 7 illustrates an example circuit for applying a bias voltage to a CMUT according to some implementations.

FIG. 7 illustrates an example circuit 700 for applying a bias voltage to a CMUT according to some implementations. In this example, the circuit 700 includes the first capacitor C1 208 and the first resistor R1 214 connected to the GND/COM 216. In addition, the circuit 700 includes the second capacitor C2 502 and the second resistor R2 602 connected in parallel. Thus, a first electrode 604 of the second resistor 602 is electrically connected to the first electrode of the second capacitor and the second electrode 206 of the CMUT 202. In addition, a second electrode 606 of the second resistor 602 is connected to the second electrode 506 of the second capacitor 502 and the bias voltage supply 124. As mentioned above, the capacitance of the second capacitor C2 502 may be larger than the capacitance of the CMUT 202. In some examples, the capacitance of the first capacitor C2 502 may be 5 times, or more, larger than the capacitance of the CMUT 202. In some examples, the capacitance of the first capacitor C2 502 may be 5 times, 10 times, 100 times, 1000 times, or more, larger than the capacitance of the CMUT 202. Further, the second resistor R2 602 may have a resistance between 1/10 to 1/3 the resistance of the first resistor R1 214, and/or the second resistor R2 602 may have an impedance 5 times, 10 times, 100 times, or more, larger than an impedance of the second capacitor C2 502 in a CMUT operating frequency range.

Figure 8:
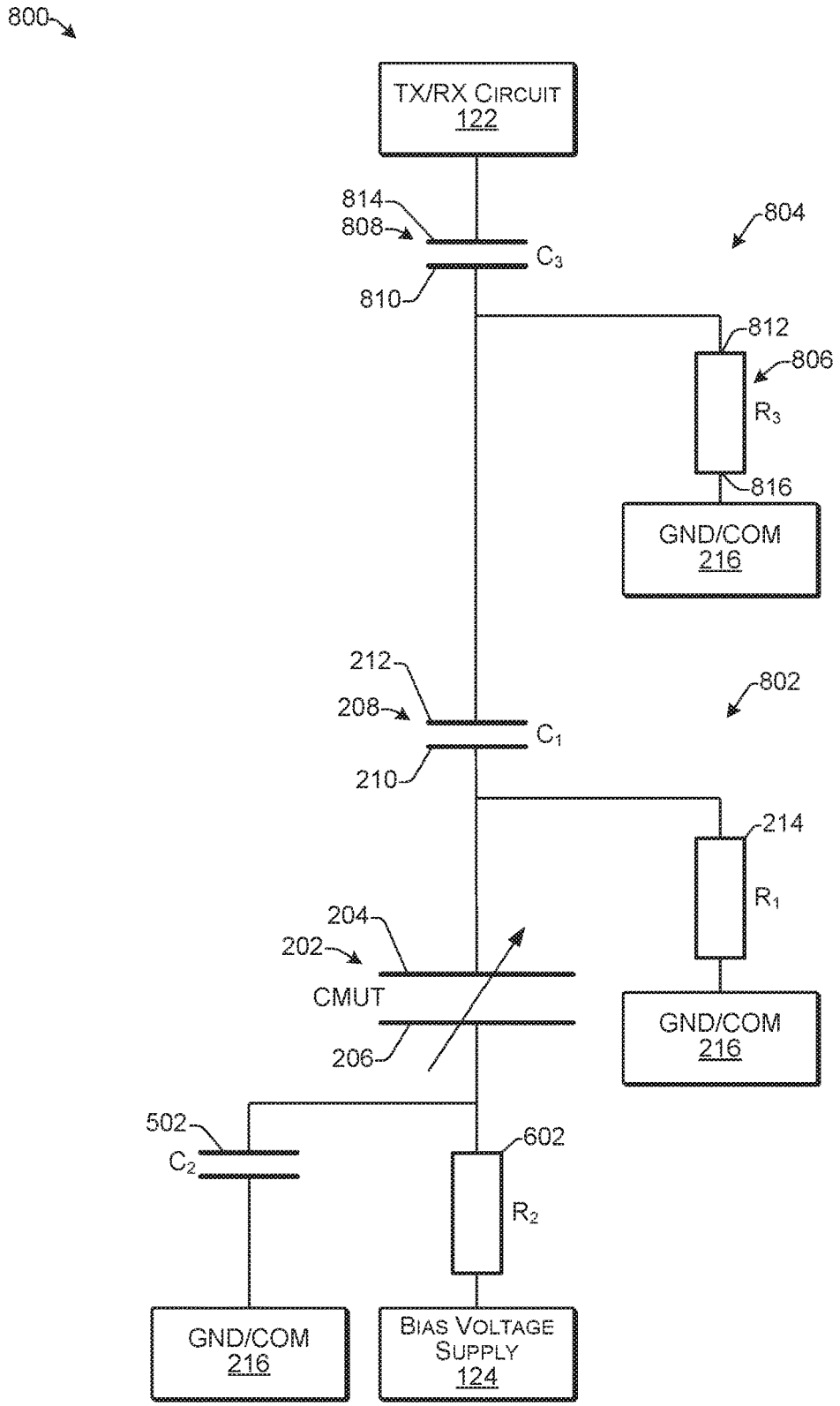
FIG. 8 illustrates an example circuit for applying a bias voltage to a CMUT according to some implementations.

FIG. 8 illustrates an example circuit 800 for applying a bias voltage to a CMUT according to some implementations. In this example, the circuit 800 includes the first capacitor C1 208 and the first resistor R1 214 connected to the GND/COM 216 as a first resistor-capacitor (RC) stage 802. Thus, the first RC stage 802 includes a circuit made up of the first resistor R1 214 and the first capacitor C1 208. Furthermore, the circuit 800 includes the TX/RX circuit 122, and a second RC stage 804 electrically connected between the first RC stage 802 and the TX/RX circuit 122. The second RC stage 802 includes a third resistor R3 806 and a third capacitor C3 808. A first electrode 810 of the third capacitor C3 808 is electrically connected to the second electrode 212 of the first capacitor C1 208 and a first electrode 812 of the third resistor 806. A second electrode 814 of the third capacitor C3 808 is connected to the TX/RX circuit 122. A second electrode 816 of the third resistor 806 is connected to the GND/COM 216. In addition, the circuit 800 includes the second capacitor 502 connected to the GND/COM 216 and the second resistor 602 connected between the bias voltage supply 124 and the CMUT 202.

The value of the capacitance of the third capacitor C3 808 may be similar to that of the first capacitor C1 208, e.g., the capacitance of the third capacitor C3 808 may be 5 times, 10 times, 100 times, 1000 times, or more, larger than the capacitance of the CMUT 202. Furthermore, the value of the resistance of the third resistor R3 806 may be similar to that of the first resistor R1 214, e.g., the resistance of the third resistor R3 806 may be selected to be larger than the impedance of the CMUT 202 in the operation frequency range of the CMUT 202. For instance, the resistance of the third resistor R3 806 may be 5 times, 10 times, 100 times, 1000 times, or more, the impedance of the CMUT 202 in the operation frequency range.

The second RC stage 804 can be connected any place between the first RC stage 804 and the TX/RX circuit 122. Moreover, the second RC 802 stage may be included in any of the circuit configurations illustrated in FIGS. 3-7. As one example, in the case that the CMUT 202 develops a short and the first capacitor C1 208 also develops a short, the second RC stage may protect the TX/RX circuit 122 from damage by the bias voltage supply 124, and therefore may be useful in medical applications, or the like.

Figure 9:
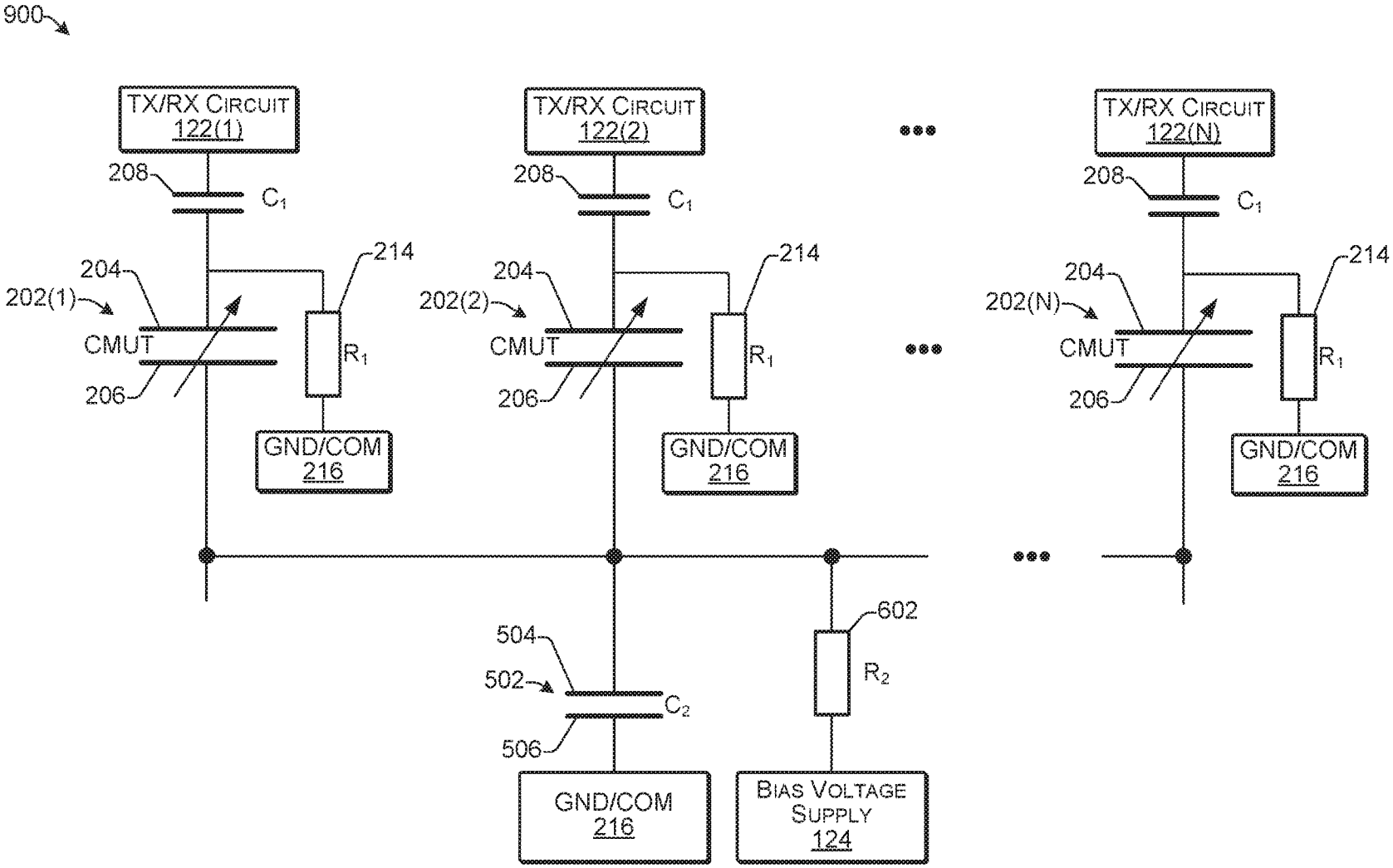
FIG. 9 illustrates an example circuit for applying a bias voltage to a CMUT according to some implementations.

FIG. 9 illustrates an example configuration of a circuit 900 of an ultrasound system including a plurality of CMUTS to which a bias voltage is applied according to some implementations. For instance, the circuit configurations in FIGS. 2-8 are described with respect to one CMUT, such as a plurality of CMUT cells, or an element or sub-element in a CMUT array. However, the circuit configurations of FIGS. 2-8 may be applied to systems including multiple CMUTs, such as multiple CMUT elements, multiple sub-elements, or a bias controllable region in a CMUT array. In this example, such as in the case of a CMUT array, multiple CMUT elements, sub-elements or a bias controllable region may share the same bias voltage supply 124. For example, CMUT arrays may be classified into three or more different array types made up of multiple CMUT elements, which include one-dimensional (1D) arrays, one-point-five-dimensional (1.5D) arrays, and two-dimensional (2D) arrays. For example, a 1D array may include multiple CMUT elements arranged in only one dimension, e.g., the lateral dimension. The spacing between two adjacent elements may be typically either one wavelength for a linear array or one-half wavelength for a phased array. A 1.5D array may include multiple elements in the lateral dimension and at least two sub-elements in the elevation dimension. A 2D array may include multiple elements arranged in both the lateral dimension and the elevation dimension. Examples of CMUT arrays are described in U.S. patent application Ser. No. 14/944,404, filed Nov. 18, 2015, and U.S. patent application Ser. No. 15/212,326, filed Jul. 18, 2016, the entire disclosures of which are incorporated by reference herein.

The example of FIG. 9 illustrates circuit 900 a system including a bias voltage application configuration for multiple CMUTs 202(1), 202(2), . . . , 202(N) that is based on the circuit configuration in FIG. 6. In some examples, the multiple CMUTs 202(1)-202(N) may each be a separate element or sub-element in a CMUT array and/or may share the same bias voltage supply 124. The second electrodes 206 of the plurality of CMUTs 202(1)-202(N) are electrically connected to each other to form a common electrode for the multiple CMUTs 202(1)-202(N). The bias voltage supply 124 may connect to the second electrodes 206 directly or indirectly. In this example, the second resistor R2 602 (in some examples, R2 may be optional) is electrically connected between the bias voltage supply 124 and the second electrodes 206 of the respective multiple CMUTs 202(1)-202(N). Additionally, the first electrode 504 of the second capacitor C2 502 is electrically connected to the second electrodes 206 of the plurality of CMUTs 202(2)-202(N) and the second electrode 506 of the second capacitor C2 502 is connect to the GND/COM 216.

Furthermore, the first electrode 204 of each CMUT 202(1)-202(N) may be connected to a separate TX/RX circuit 122(1), 122(2), . . . , 122(N), which may be the front-end circuit of a separate channel of an ultrasound system in some examples. Further, as in the example of FIG. 2, a respective first capacitor C1 208 and a respective first resistor R1 214 that is connected to GND/COM 216 may be connected between the CMUTS 202(1)-202(N) and the respective TX/RX circuits 122(1)-122(N). Thus, each CMUT 202(1)-202(N) may be connected to a respective first capacitor 208, a respective first resistor 214, and a respective TX/RX circuit 122(1)-122(N), and the plurality of CMUTs may share a connection to the bias voltage supply 124, the second capacitor 502, and the second resistor 602. Further, the configuration of the circuit 900 may be just one of multiple circuits 900 that may be employed in a CMUT array, such as in the case that different bias voltages are applied to different parts of the array. For example, a first circuit 900 may be applied to a first set of elements or sub-elements, or a first bias controllable region (e.g., regions of CMUT cells having separately controllable bias voltages to impart different properties to the different regions) in the array, and as second circuit 900 may be applied to a second set of elements or sub-elements, or a second bias controllable region in the array to enable application of different bias voltages of different voltage amounts and or at different timings of applying the different bias voltages.

Furthermore, multiple CMUTs 202(1), 202(2), . . . , 202(N) may be grouped into multiple groups. The multiple CMUTs in each group may share the same bias voltage supply 124. The bias voltage supplies 124 for each respective group may be different. Further, each group of CMUTs may include multiple CMUT elements, CMUT sub-elements, or may be a bias-controllable CMUT region (e.g., regions of CMUT cells having separately controllable bias voltages to impart different properties to the different regions). Each CMUT (e.g., CMUT element, sub-element, or other CMUT region) of the multiple CMUTs in each group may have the respective first capacitor and the respective first resistor, and each group may have a respective second capacitor C2 502 and, optionally, a respective second resistor R2 602.

Figure 10:
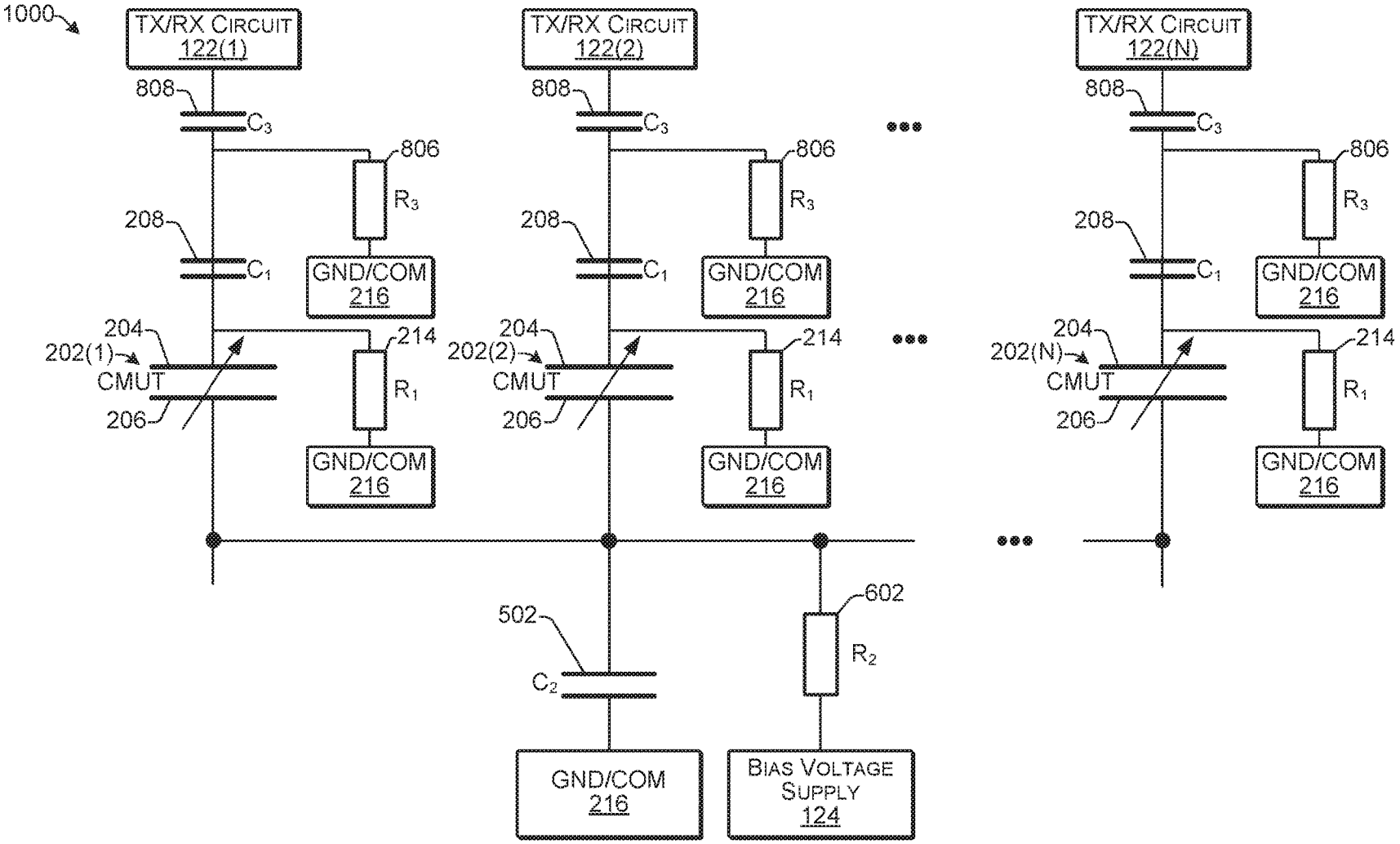
FIG. 10 illustrates an example circuit for applying a bias voltage to a CMUT according to some implementations.

FIG. 10 illustrates an example configuration of a circuit 1000 of an ultrasound system including a plurality of CMUTS to which a bias voltage is applied according to some implementations. For instance, in this example, the circuit configuration of FIG. 8 may be applied to systems that include multiple CMUTs, such as multiple CMUT elements or sub-elements in a CMUT array. Thus, the circuit 1000 may be included in a system in which a bias voltage is applied to multiple CMUTs 202(1), 202(2), . . . , 202(N). In some examples, the multiple CMUTs 202(1)-202(N) may each be a separate element or sub-element in a CMUT array and/or may share the same bias voltage supply 124. The second electrodes 206 of the plurality of CMUTs 202(1)-202(N) are electrically connected to each other to form a common electrode for the multiple CMUTs 202(1)-202(N). The bias voltage supply 124 may connect to the second electrodes 206 directly or indirectly. In this example, the second resistor R2 602 (which may be optional in some cases) is electrically connected between the bias voltage supply 124 and the second electrodes 206 of the respective multiple CMUTs 202(1)-202(N). Additionally, the first electrode 504 of the second capacitor C2 502 is electrically connected to the second electrodes 206 of the plurality of CMUTs 202(2)-202(N) and the second electrode 506 of the second capacitor C2 502 is connected to the GND/COM 216.

Furthermore, the first electrode 204 of each CMUT 202(1)-202(N) may be connected to a separate TX/RX circuit 122(1), 122(2), . . . , 122(N), which may be a separate channel of a TX/RX circuit in some examples. Further, as in the example of FIG. 2, a respective first capacitor C1 208 and a respective first resistor R1 214 connected to GND/COM 216 may be connected between the CMUTS 202(1)-202(N) and the respective TX/RX circuits 122(1)-122(N). In addition, a respective third capacitor C3 808 and third resistor R3 806 that is connected to the GND/COM 216 is also connected between the respective TX/RX circuit 122(1)-122(N) and each respective CMUT 202(1)-202(N).

Thus, each CMUT 202(1)-202(N) may be connected to a respective first capacitor 208, a respective first resistor 214, and a respective TX/RX circuit 122(1)-122(N), and the plurality of CMUTs may share a connection to the bias voltage supply 124, the second capacitor 502, and the second resistor 602. Further, the configuration of the circuit 1000 may be just one of multiple circuits 1000 that may be employed in a CMUT array, such as in the case that different bias voltages are applied to different parts of the array. For example, a first circuit 1000 may be applied to a first set of elements or sub-elements in the array, and as second circuit 1000 may be applied to a second set of elements or sub-elements in the array to enable application of different bias voltages of different voltage amounts and or at different timings of applying the different bias voltages.

The configurations with multiple CMUTs illustrated in the circuits of FIG. 9 and FIG. 10 are based on the configurations illustrated in FIG. 6 and FIG. 8, respectively. The other circuit configurations discussed above with respect to FIGS. 2-5 and 7 may be similarly implemented with multiple CMUTs.

Figure 11:
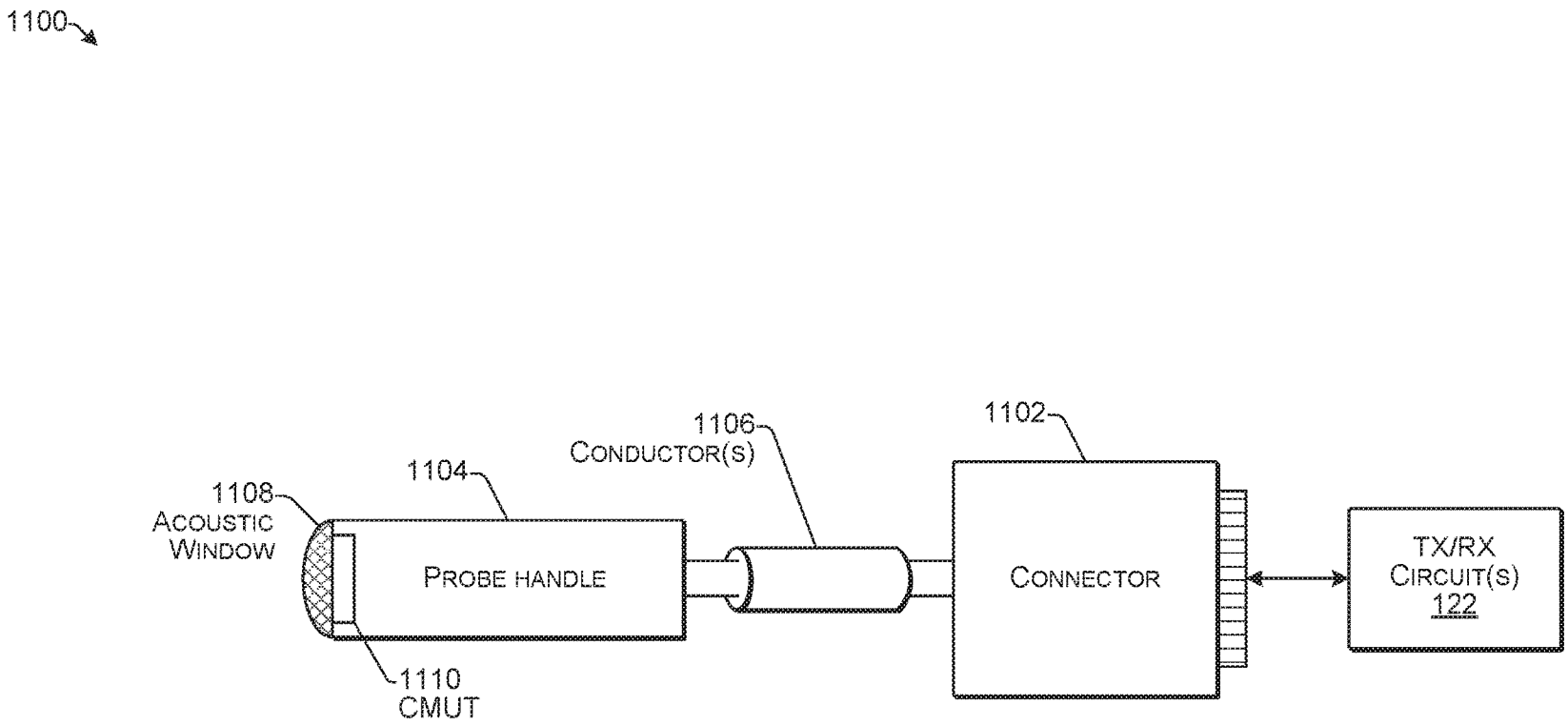
FIG. 11 illustrates an example configuration of an ultrasound system including one or more CMUTS according to some implementations.

FIG. 11 illustrates an example configuration of an ultrasound probe system 1100 including one or more CMUTS according to some implementations. In this example, the ultrasound probe system 1100 includes a connector 1102, interfacing with one or more TX/RX circuits 122, connected to a probe handle 1104 by one or more conductors 1106. The one or more conductors 1106 may include a co-axial cable or other type of cable, wires, conductive leads, or the like, providing electrical connection between the probe handle and the connector 1102. In some cases, the one or more conductors 1106 may be a cable bundle that may include multiple co-axial cables, multiple pairs of wires, multiple pairs of leads, or the like.

The probe handle may include an acoustic window 1108 and a CMUT 1110. In some cases, the one or more conductors 1106 may be flexible to allow a user to manipulate freely the probe handle 1104. For instance, the probe handle 1104 may be designed to be light and small. Consequently, in some examples herein, the number of components in the probe handle 1104 may be minimized in favor of placing the components in the connector 1102. Accordingly, the protective components, such as the first capacitors C1 and the first resistors R1, and/or other protective components, may be included in the connector 1102. In particular, since each TX/RX circuit (e.g., each system channel) may include a pair of the first capacitor C1 and the first resistor R1, and in some cases, there may be a large number of channels, including these components in the probe handle 1104 may substantially increase the size of the probe handle 1104.

As one example, suppose that the CMUT 1110 is a CMUT array having a large number of CMUT elements, thus there are a large number of the first capacitors and first resistors, e.g., one pair for each CMUT element. Additionally, based on the example circuits of FIGS. 2-10, a large number of capacitors and resistors may be included in the ultrasound probe system with the large number of CMUT elements. However, if a large number of the capacitors and resistors are included in the probe handle 1104 as protective components, the handle 1104 may significantly increase in both size and weight as compared to the handle 1104 without the protective components. Accordingly, based on the example circuits discussed in FIGS. 2-10, in some examples, the capacitors 208, 502, 808, and/or the resistor(s) 214, 602, 806 (e.g., as illustrated in one or more of FIGS. 2-10—not shown in FIG. 11) may be located in the connector 1102 rather than the probe handle 1104. Additionally, or alternatively, as discussed below, the second capacitor 502 and/or the optional second resistor 602 may be located in the probe handle 1104 or at another suitable location in the system 1100.

Figure 12:
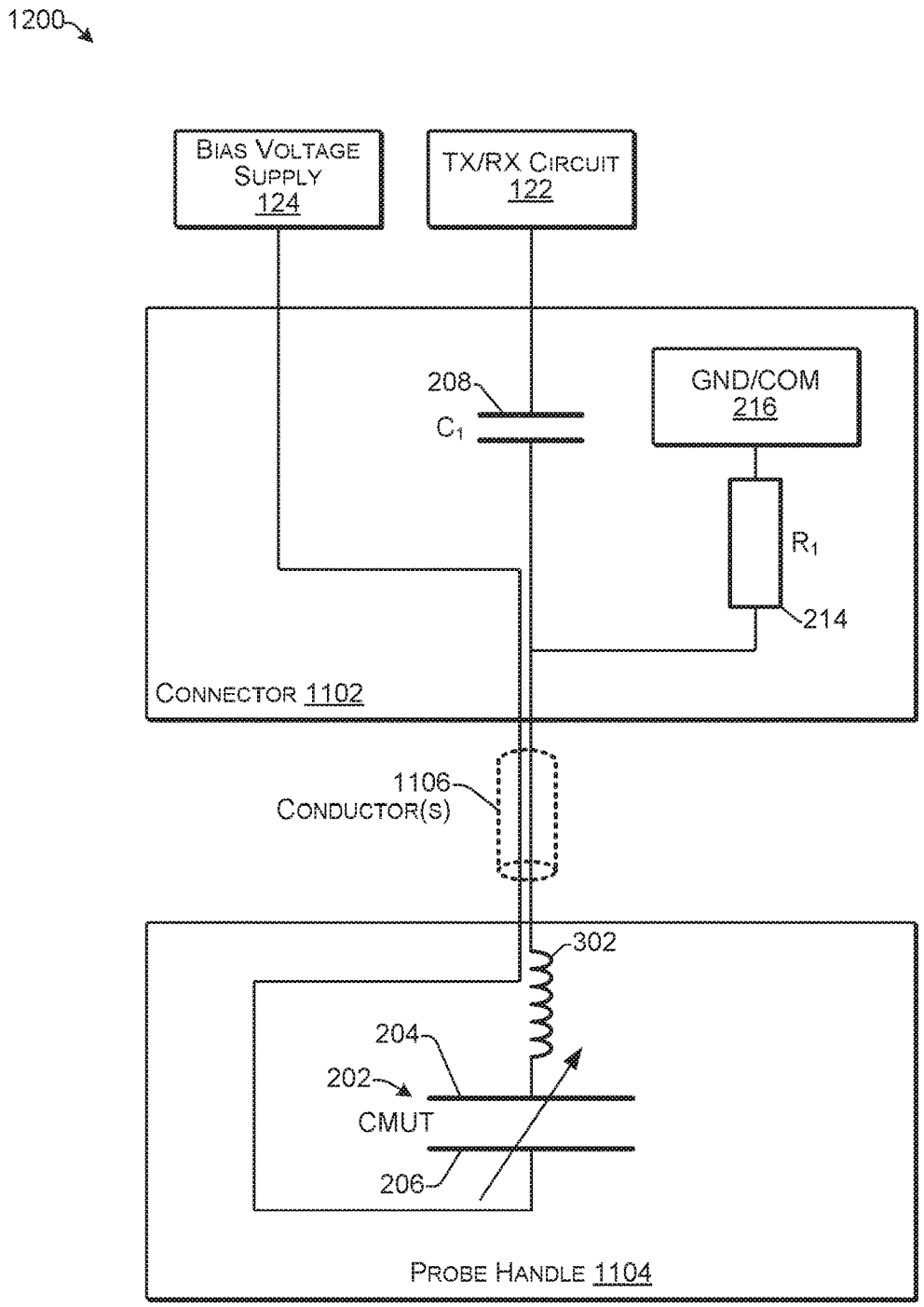
FIG. 12 illustrates an example configuration of an ultrasound system including one or more CMUTS according to some implementations.

FIG. 12 illustrates an example configuration of an ultrasound probe system 1200 including one or more CMUTS according to some implementations. The example probe system 1200 illustrates one possible configuration of the probe system 1100 in which at least some of the protective components are included in the connector 1102. The example of FIG. 12 corresponds to the circuit 300 of FIG. 3, but others of the circuits described in FIGS. 2-10 may be similarly configured in the probe system 1200. In the illustrated example, the first capacitor 208 and the first resistor 214 are located in the connector 1102. In some examples, a respective inductor 302 may be included and may be disposed in the probe handle 1104 to be close to the respective CMUT 202 for tuning the respective CMUT 202. Similar implementations may be used for the circuit configurations of FIGS. 2 and 4-10.

Furthermore, the bias voltage supply 124 may be disposed in the ultrasound system 1200 (as shown) and connected to the connector 1102. The bias voltage supply 124 may alternatively be disposed in the connector 1102. As another alternative, the bias voltage supply may be disposed in the probe handle 1104. The bias voltage supply 124 may have power supplied by the ultrasound system 1200, a battery, or other power source (not shown in FIG. 12).

Figure 13:
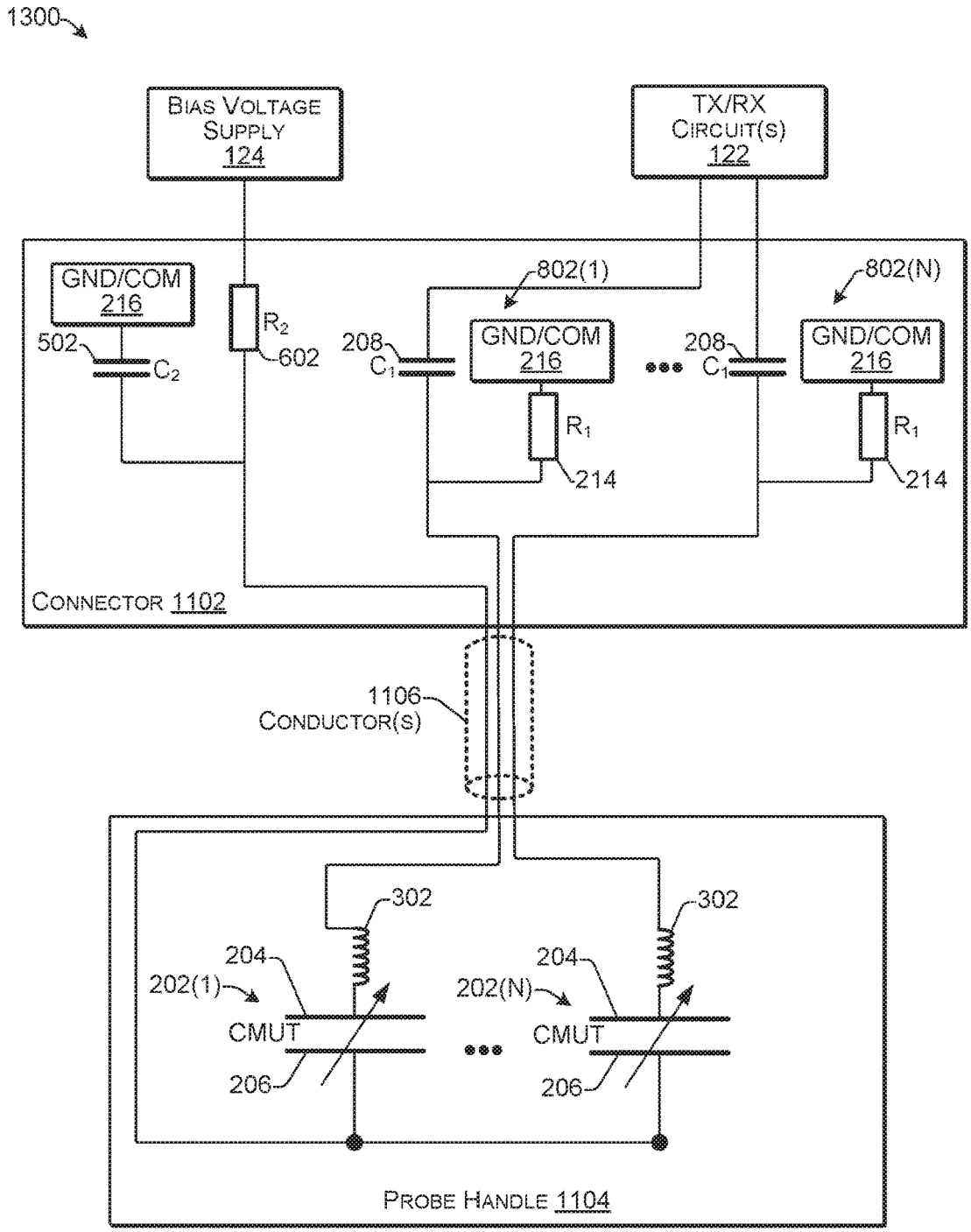
FIG. 13 illustrates an example configuration of an ultrasound system including a plurality of CMUTS according to some implementations.

FIG. 13 illustrates an example configuration of an ultrasound probe system 1300 including a plurality of CMUTS according to some implementations. As one example, the CMUTS 202(1)-202(N) may be included in a CMUT array, and may correspond, for example, to CMUT elements or sub-elements, respectively, in the CMUT array. The example probe system 1300 illustrates one possible configuration of the probe system in which at least some of the protective components are included in the connector 1102. The example of FIG. 13 corresponds to a combination of the circuits 300 of FIG. 3 and 900 of FIG. 9, but others of the circuits described in FIGS. 2, 4-8 and 10 may be similarly configured in the probe system 1300.

In the illustrated example, a plurality of first RC stages 802(1)-802(N), including the first capacitors C1 208 and the first resistors R1 214, are located in the connector 1102 and are in communication with one or more TX/RX circuits 122, which may include a plurality of TX/RX channels in some examples. Since there may be relatively few second capacitors C2 502 and second resistors R2 602 for each array (in some examples, there may be only one pair of the second capacitor 502 and second resistor 602 for a regular 1D array, or one pair for each bias controllable region or sub-element in a 1.5D array), the second capacitor C2 502 and the second resistor R2 602 may be located in the connector 1102, the probe handle 1104, or other location in the ultrasound system 1300. The second capacitor C2 502, and the optional second resistor R2 602 are located in the connector 1102 in the illustrated example, and are in communication with the bias voltage supply 124.

The plurality of CMUTS 202(1)-202(N) are disposed in the probe handle 1104. In some examples, respective inductors 302 may be included and may be disposed in the probe handle 1104 to be close to the respective CMUTs 202 that they tune. The implementation of FIG. 10 may be similarly incorporated into the probe system 1300. The bias voltage supply 124 may be disposed in the ultrasound system 1300 (as illustrated) and connected to the connector 1102. As an alternatively, the bias voltage supply 124 may be disposed in the connector 1102. As another alternative, the bias voltage supply 124 may be disposed in the probe handle 1104. The bias voltage supply 124 may have power supplied by the ultrasound system 1300, a battery, or other power source (not shown in FIG. 13).

FIG. 14 is a block diagram illustrating an example configuration of an ultrasound system 1400 including one or more CMUTS according to some implementations. In this example, the system 1400 includes one or more CMUTs 1402. In some cases, the CMUT(s) 1402 may correspond to at least one of the CMUT 102 or 202 discussed above with respect to FIGS. 1-13. The system 1400 further includes an imaging system 1406, a multiplexer 1408, and a bias voltage supply 1410 in communication with the CMUT 1402. As one non-limiting example, the system 1400 may include, or may be included in, an ultrasound probe for performing ultrasound imaging, as discussed above with respect to FIGS. 11-13.

Further, the system 1400 may include multiple TX/RX channels 1412. For instance, the CMUT 1402 may include 128 (e.g., N) transmit and receive channels 1412 that communicate with the multiplexor 1408. In some examples, the properties of at least some of the CMUT(s) 1402 may vary or may be varied by varying the bias voltage supplied to the CMUT(s) 1402. Further, in some cases, the physical configurations of the CMUT cells within the CMUT(s) 1402 may vary, which may also vary the transmit and receive properties of different bias controllable regions.

In addition, as indicated at 1416, the bias voltage supply 1410 may generate one or more bias voltages to apply to the one or more CMUTs 1402. Further, in some examples, the bias voltage generated may be time-dependent, and may change over time.

The imaging system 1406 may include one or more processors 1418, one or more computer-readable media 1420, and a display 1422. For example, the processor(s) 1418 may be implemented as one or more physical microprocessors, microcontrollers, digital signal processors, logic circuits, and/or other devices that manipulate signals based on operational instructions. The computer-readable medium 1420 may be a tangible non-transitory computer storage medium and may include volatile and nonvolatile memory, computer storage devices, and/or removable and non-removable media implemented in any type of technology for storage of information such as signals received from the CMUT 1402 and/or processor-executable instructions, data structures, program modules, or other data. Further, when mentioned herein, non-transitory computer-readable media exclude media such as energy, carrier signals, electromagnetic waves, and signals per se.

In some examples, the imaging system 1406 may include, or may be connectable to the display 1422 and/or various other input and/or output (I/O) components such as for visualizing the signals received by the CMUT 1402. In addition, the imaging system 1406 may communicate with the multiplexer 1408 through a plurality of TX/RX channels 1424. Furthermore, the imaging system 1406 may communicate directly with the multiplexer 1408, such as for controlling a plurality of switches therein, as indicated at 1428, in addition to communicating with the bias voltage supply 1410, as indicated at 1426.

The multiplexer 1408 may include a large number of high voltage switches and/or other multiplexing components. The implementations herein may be used for any number of channels 1424, any number of channels 1412, and any number of CMUTs 1402. The one or more CMUTs 1402 may be connected to the bias voltage supply 1410 and the TX/RX channels 1412 using any of the circuit configurations discussed above with respect to FIGS. 1-13.

Figure 15:
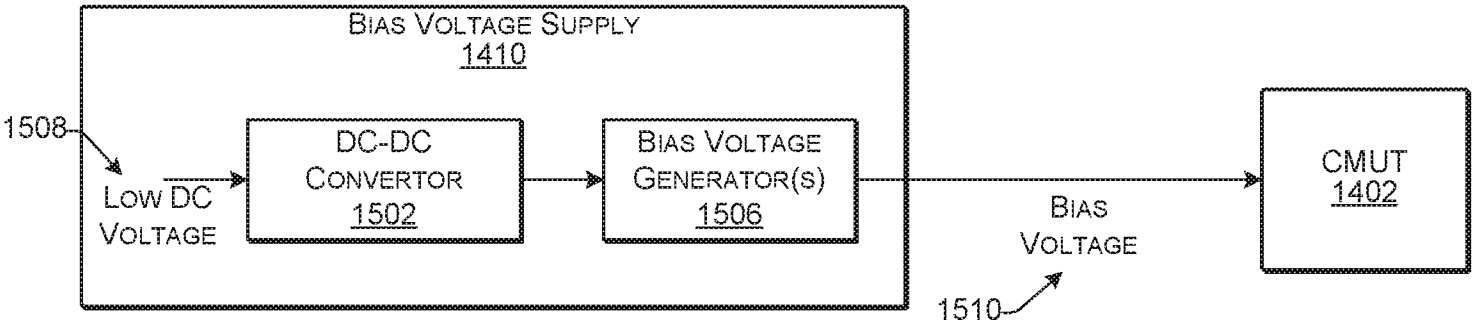
FIG. 15 is a block diagram illustrating an example of select components of bias voltage supply according to some implementations.

FIG. 15 is a block diagram illustrating an example of select components of the bias voltage supply 1410 according to some implementations. The bias voltage supply 1410 may include a DC-to-DC converter 1502 and one or more bias generators 1506. The DC-to-DC converter 1502 of the bias voltage supply 1410 may convert a low DC voltage 1508 (e.g., 5V, 10V, etc.), into a high DC voltage such as 200V, 400V, etc. In some examples, the bias generator 1506 may generate a monotonically increasing bias voltage 1510 to the one or more CMUTs 1402, such as after receiving a start signal. For example, the bias voltage 1510 may increase over time as discussed additionally below. Furthermore, in some examples, the bias generator 1506 may reduce the level of the bias voltage 1510 to an initial voltage, e.g., 0V relatively quickly after receiving an end signal or at a predetermined time. The bias voltage generator 1506 may be implemented using at least one of analog or digital techniques.

Figure 16:
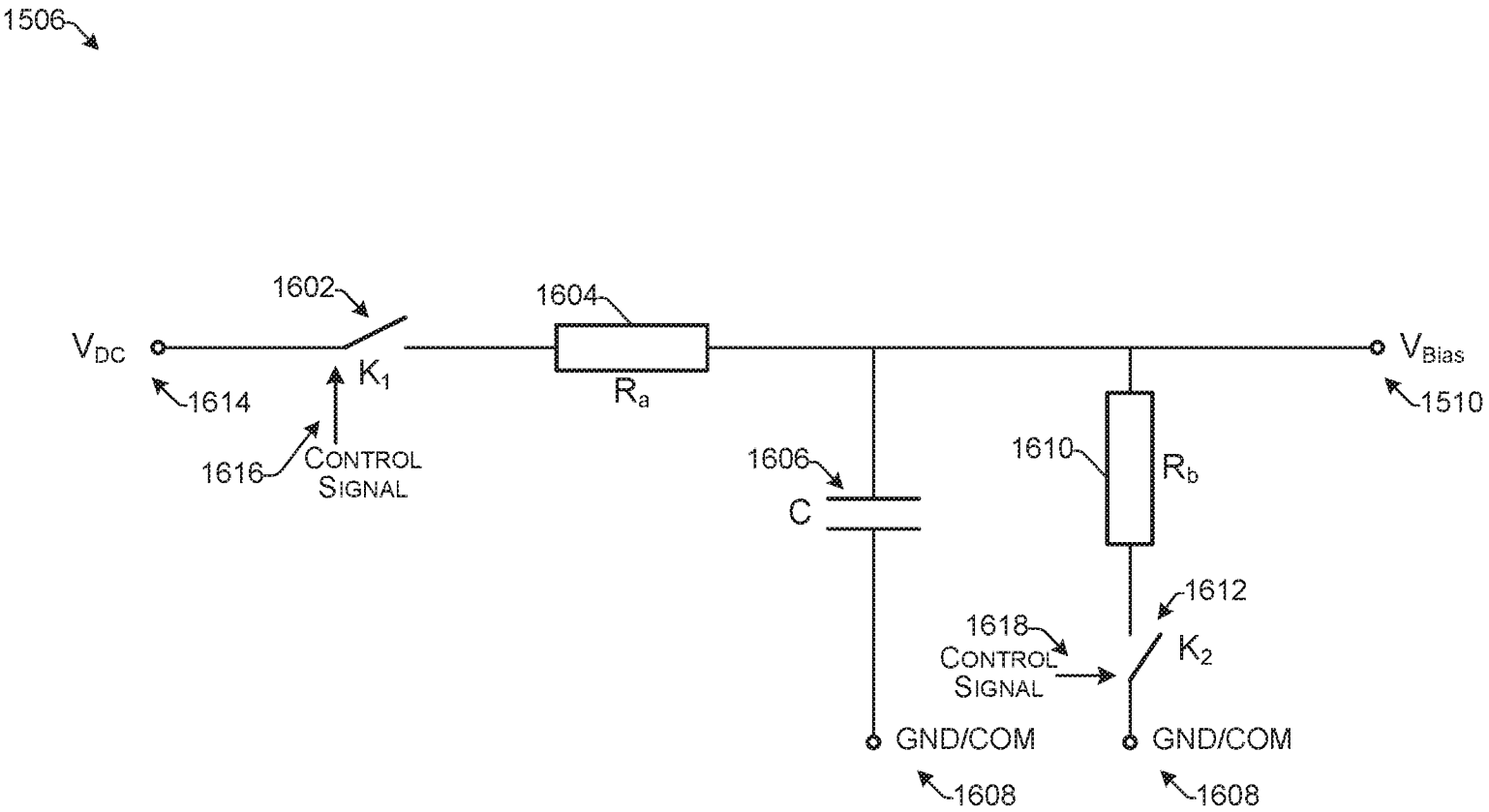
FIG. 16 illustrates an example of a bias voltage generator according to some implementations.

FIG. 16 illustrates an example of a bias voltage generator 1506 according to some implementations. The bias voltage generator 1506 in this example may be an analog bias voltage generator, and includes a first switch $K_1$ 1602, a first resistor $R_a$ 1604, a capacitor C 1606 connected to ground/common 1608, and a second resistor $R_b$ 1610 connectable to ground/common 1608 by a second switch $K_2$ 1612. When the first switch $K_1$ 1602 is closed, a voltage $V_{DC}$ 1614 provided to the bias voltage generator 1506 starts to charge the capacitor C 1606 and the bias voltage $V_{bias}$ 1510 increases exponentially at rate $(1-e^{-t/\tau})$, where $\tau=R_aC$ is a time constant. As one example, after the ultrasound signal reaches a predetermined depth, the first switch $K_1$ 1602 may be opened and the second switch $K_2$ 1612 may be closed. This causes the bias voltage $V_{bias}$ 1510 to drop 0V quickly as the capacitor C 1606 discharges through resistor $R_b$ 1610. In some cases, the second resistor $R_b$ 1610 may have a significantly smaller resistance than the first resistor $R_a$ 1604. Furthermore, control signals 1616 and 1618, respectively, that turn on and off the first switch $K_1$ 1602 and the second switch $K_2$ 1612 may be generated by the processor 1418 of the imaging system discussed above with respect to FIG. 14, or by a separate timing apparatus inside the system. The timing apparatus may be analog or digital.

Figure 17:
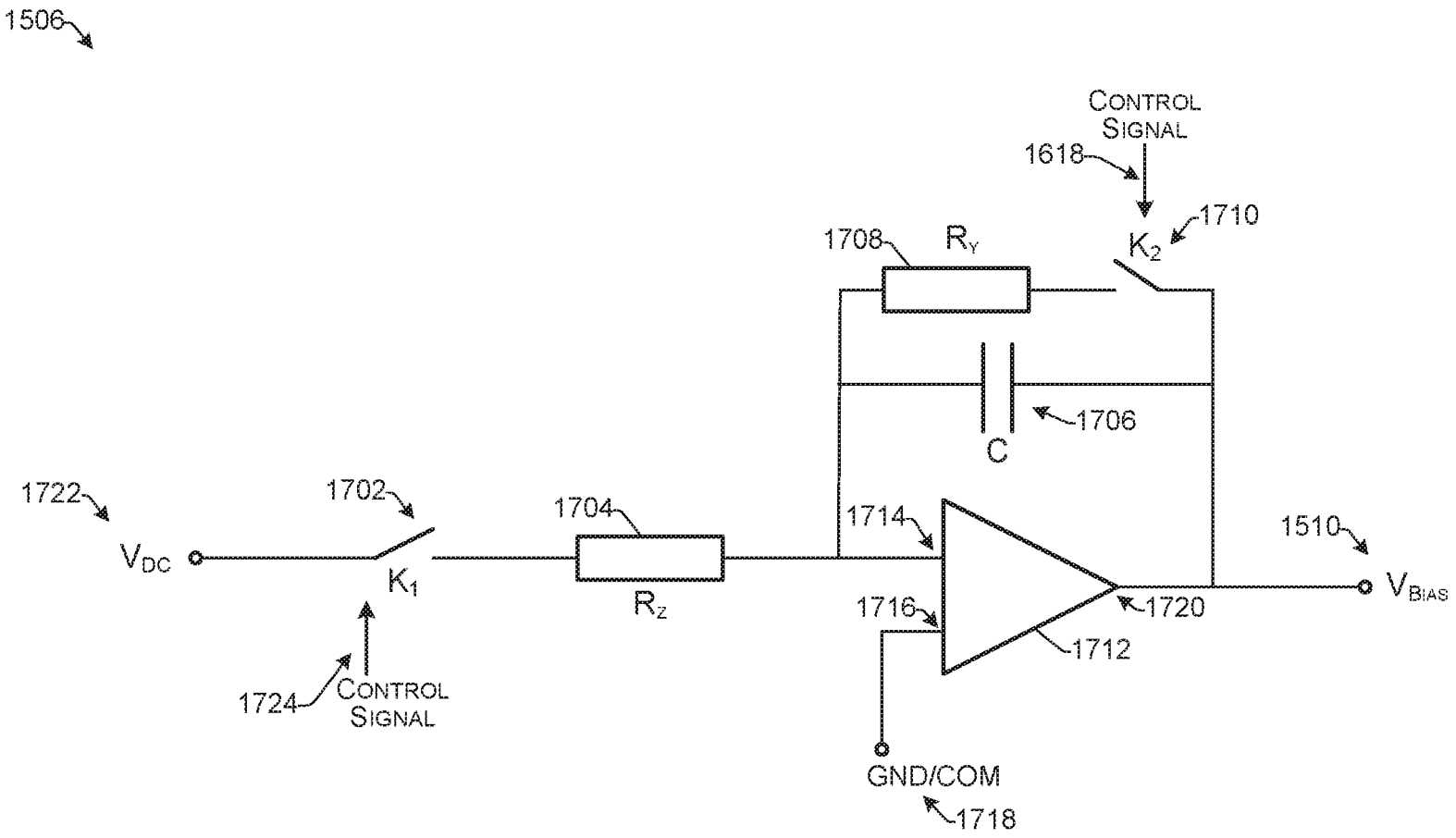
FIG. 17 illustrates an example of a bias voltage generator according to some implementations.

FIG. 17 illustrates an example of a bias voltage generator 1506 according to some implementations. The bias voltage generator 1506 in this example may be an analog bias voltage generator, and includes a first switch $K_1$ 1702, a first resistor $R_z$ 1704, a capacitor C 1706, and a second resistor $R_y$ 1708 connectable in parallel with the capacitor C 1706 by a second switch $K_2$ 1710. In addition, the bias voltage generator 1506 includes an amplifier 1712 having a first connection 1714, a second connection 1716 connected to ground/common 1718, and a third connection 1720. A voltage $V_{DC}$ 1722 may be provided to the bias voltage generator 1506. The amplifier 1712 creates an integration circuit such that when the first switch $K_1$ 1702 is closed, the bias voltage $V_{bias}$ 1510 starts to increase linearly at rate $t/\tau$, where $\tau=R_zC$ is a time constant. As one example, after the ultrasound signal reaches a predetermined depth, the first switch $K_1$ 1702 may be opened and the second switch $K_2$ 1710 may be closed, which causes the $V_{bias}$ 1510 to drop quickly to 0V as the capacitor C 1706 discharges through the second resistor $R_y$ 1708. In some cases, the second resistor $R_y$ 1708 may have a significantly smaller resistance than the first resistor $R_z$ 1704. Furthermore, control signals 1724 and 1726, respectively, may turn on and off the first switch $K_1$ 1702 and the second switch $K_2$ 1710, and may be generated by the processor 1418 of the imaging system 1406 discussed above with respect to FIG. 14, or by a separate timing apparatus inside the system. The timing apparatus may be analog or digital.

Although two analog examples of the bias voltage generator 1506 are presented here, similar principles may be extended to other analog circuits able to generate variable voltage outputs, as will be apparent to those of skill in the art having the benefit of the disclosure herein. Further, in some examples, as mentioned above, a digital version of the bias voltage generator 1506 may be employed.

Figure 18:
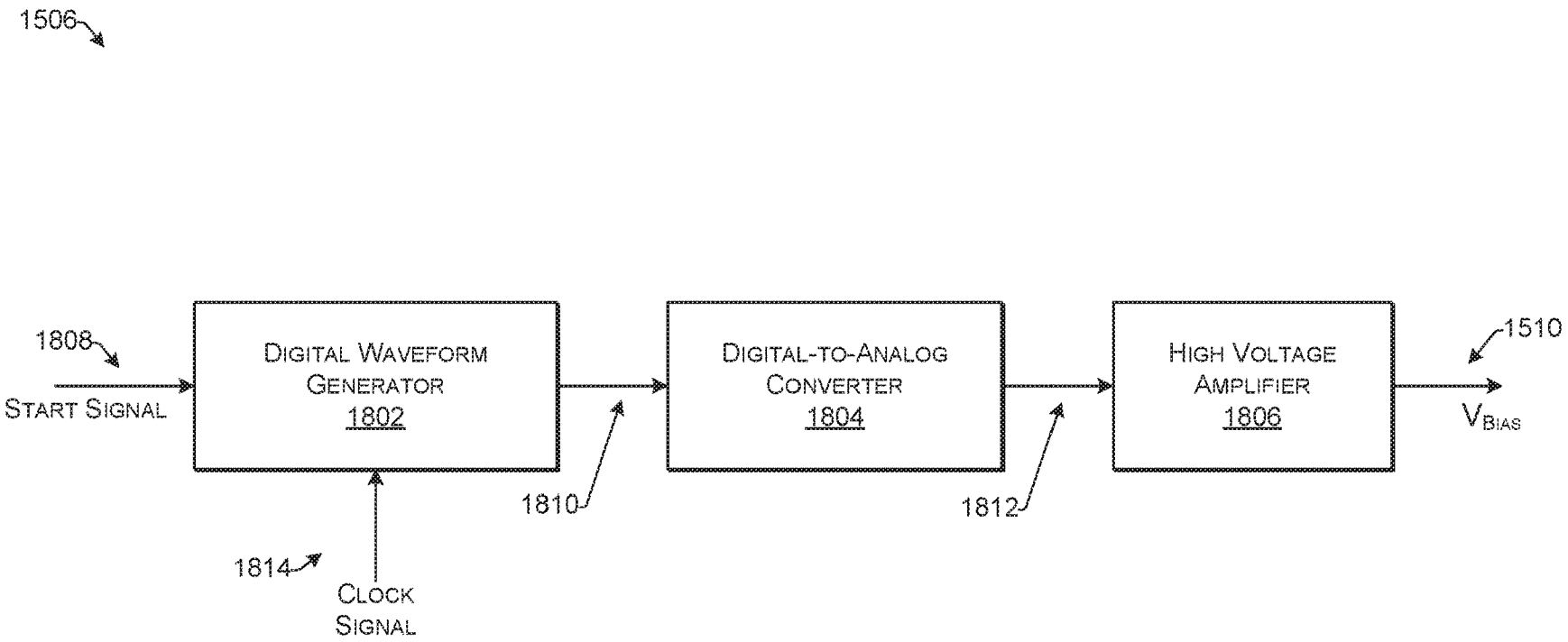
FIG. 18 illustrates an example of a bias voltage generator according to some implementations.

FIG. 18 illustrates an example of a bias voltage generator 1506 according to some implementations. In this example, the bias voltage generator 1506 may be a digital bias voltage generator, and may include a digital waveform generator 1802, a digital-to-analog converter 1804, and a high-voltage amplifier 1806. The digital waveform generator 1802 receives a start signal 1808 and begins outputting a digital waveform at 1810. The digital-to-analog convertor 1804 converts the digital waveform 1810 into an analog voltage signal 1812. Subsequently, the high voltage amplifier 1806 scales the analog voltage signal 1812 to a desired bias level to generate the bias voltage 1510. As one example, after the ultrasound signal reaches a predetermined depth, a stop signal may be sent to the digital waveform generator 1802, which causes the $V_{bias}$ 1510 to drop to 0V. A clock signal 1814 to control the digital waveform generator 1802 may be generated by the processor 1418 of the imaging system 1406 discussed above with respect to FIG. 14, or by a separate timing apparatus inside the system. The timing apparatus may be analog or digital.

Figure 19:
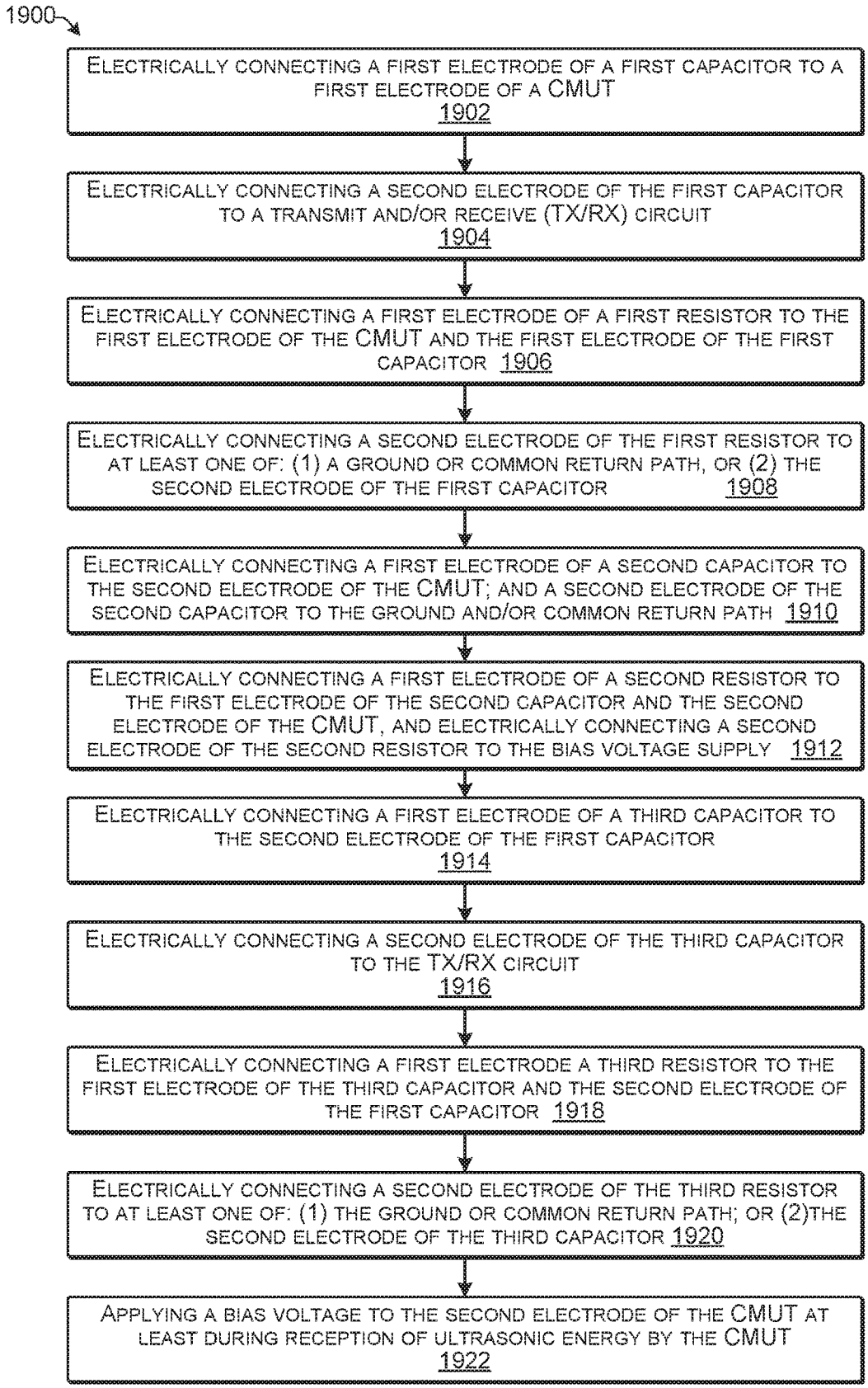
FIG. 19 is a flow diagram illustrating an example process for applying a bias voltage according to some implementations.

FIG. 19 is a flow diagram illustrating an example process according to some implementations. The process is illustrated as a collection of blocks in a logical flow diagram, which represent a sequence of operations. The order in which the blocks are described should not be construed as a limitation. Any number of the described blocks may be combined in any order and/or in parallel to implement the processes, or alternative processes, and not all of the blocks need be executed. For discussion purposes, the process is described with reference to the apparatuses, architectures, and systems described in the examples herein, although the process may be implemented in a wide variety of other apparatuses, architectures, and systems.

FIG. 19 is a flow diagram illustrating an example process 1900 for applying a bias voltage to a CMUT according to some implementations. The process may be executed, at least in part by a processor programmed or otherwise configured by executable instructions.

At 1902, a first electrode of a first capacitor may be electrically connected to a first electrode of a CMUT. As one example, a capacitance of the first capacitor may be 5 times or more larger than a capacitance of the CMUT. Other suitable ranges are discussed above.

At 1904, a second electrode of the first capacitor may be electrically connected to a transmit and/or receive (TX/RX) circuit.

At 1906, a first electrode of a first resistor may be electrically connected to the first electrode of the CMUT and the first electrode of the first capacitor. For instance, a resistance of the first resistor may be 5 times or more larger than an impedance of the CMUT in an operating frequency range of the CMUT. Other suitable ranges are discussed above.

At 1908, a second electrode of the first resistor may be electrically connected to at least one of: (1) a ground or common return path, or (2) the second electrode of the first capacitor.

At 1910, a first electrode of a second capacitor may be electrically connected to the second electrode of the CMUT. Further, a second electrode of the second capacitor may be electrically connected to the ground and/or common return path. As one example, the capacitance of the second capacitor may be 5 times, or more, larger than a capacitance of the CMUT. Other suitable ranges are discussed above.

At 1912, a first electrode of a second resistor may be electrically connected to the first electrode of the second capacitor and the second electrode of the CMUT, and a second electrode of the second resistor may be electrically connected to the bias voltage supply. In some examples, a resistance of the second resistor may be 1/10 to 1/3 a resistance of the first resistor, and/or an impedance of the second resistor may be 5 times, or more, larger than an impedance of the second capacitor in a CMUT operating frequency range. Other suitable ranges are discussed above.

At 1914, a first electrode of a third capacitor may be electrically connected to the second electrode of the first capacitor. For instance, a capacitance of the third capacitor may be 5 times, or more, larger than a capacitance of the CMUT. Other suitable ranges are discussed above.

At 1916, a second electrode of the third capacitor may be electrically connected to the TX/RX circuit.

At 1918, a first electrode of a third resistor may be electrically connected to the first electrode of the third capacitor and the second electrode of the first capacitor. As one example, a resistance of the third resistor may be 5 times, or more, larger than an impedance of the CMUT in an operating frequency range of the CMUT. Other suitable ranges are discussed above.

At 1920, a second electrode of the third resistor may be electrically connected to at least one of: (1) the ground or common return path, or (2) the second electrode of the third capacitor.

At 1922, a bias voltage may be applied to the second electrode of the CMUT at least during reception of ultrasonic energy by the CMUT. For example, the applied bias voltage may pass through the second resistor to the second electrode of the CMUT when the second resistor is present. As one example, a processor in the system may cause the CMUT to transmit and/or receive ultrasonic energy while applying the bias voltage to the second electrode of at least one CMUT. In some cases, a first bias voltage may be applied to a first CMUT and a second bias voltage may be applied to a second CMUT. Further, in some examples, at least one of the first bias voltage or the second bias voltage may be applied as an increasing bias voltage that increases over time.

The example processes described herein are only examples of processes provided for discussion purposes. Numerous other variations will be apparent to those of skill in the art in light of the disclosure herein. Further, while the disclosure herein sets forth several examples of suitable systems, architectures and apparatuses for executing the processes, implementations herein are not limited to the particular examples shown and discussed. Furthermore, this disclosure provides various example implementations, as described and as illustrated in the drawings. However, this disclosure is not limited to the implementations described and illustrated herein, but can extend to other implementations, as would be known or as would become known to those skilled in the art.

Although the subject matter has been described in language specific to structural features and/or methodological acts, it is to be understood that the subject matter defined in the appended claims is not necessarily limited to the specific features or acts described. Rather, the specific features and acts are disclosed as example forms of implementing the claims.

What is claimed is:

1. A system comprising:

a capacitive micromachined ultrasonic transducer (CMUT) including a first electrode and a second electrode, wherein the second electrode is opposed to the first electrode;

a bias voltage supply for supplying a bias voltage to the second electrode;

a transmit and/or receive (TX/RX) circuit;

a first capacitor having a first electrode electrically connected to the first electrode of the CMUT, the first capacitor having a second electrode electrically connected to the TX/RX circuit;

a first resistor having a first electrode electrically connected to the first electrode of the first capacitor and the first electrode of the CMUT, the first resistor having a second electrode electrically connected to at least one of:

a ground or common return path; or the second electrode of the first capacitor; and a second capacitor having a first electrode electrically connected to the second electrode of the CMUT, the second capacitor having a second electrode electrically connected to at least one of the ground or common return path.

2. The system as recited in claim 1, wherein a capacitance of the first capacitor is larger than a capacitance of the CMUT.

3. The system as recited in claim 1, wherein a capacitance of the first capacitor is 5 times or more larger than a capacitance of the CMUT.

4. The system as recited in claim 1, wherein a capacitance of the first capacitor is 100 times or more larger than a capacitance of the CMUT.

5. The system as recited in claim 1, wherein a resistance of the first resistor is 5 times or more larger than an impedance of the CMUT in an operating frequency range of the CMUT.

6. The system as recited in claim 1, wherein a capacitance of the second capacitor is 5 times or more larger than a capacitance of the CMUT.

7. The system as recited in claim 1, further comprising a second resistor having a first electrode electrically connected to the first electrode of the second capacitor and the second electrode of the CMUT, the second resistor having a second electrode electrically connected to the bias voltage supply, wherein:

a resistance of the second resistor is 1/10 to 1/3 a resistance of the first resistor, and/or an impedance of the second resistor is 5 times or more larger than an impedance of the second capacitor in a CMUT operating frequency range.

8. The system as recited in claim 1, further comprising:

a third capacitor having a first electrode electrically connected to the second electrode of the first capacitor, the third capacitor having a second electrode electrically connected to the TX/RX circuit, wherein a capacitance of the third capacitor is 5 times or more larger than a capacitance of the CMUT; and a third resistor having a first electrode electrically connected to the first electrode of the third capacitor and the second electrode of the first capacitor, the third resistor having a second electrode electrically connected to at least one of:

the ground or common return path; or the second electrode of the third capacitor, wherein a resistance of the third resistor is 5 times or more larger than an impedance of the CMUT in an operating frequency range of the CMUT.

9. The system as recited in claim 1, further comprising a probe handle connected to a connector by one or more conductors, wherein:

the first capacitor and the first resistor are disposed in the connector, and the CMUT is disposed in the probe handle.

10. The system as recited in claim 1, further comprising an inductor electrically connected between the first electrode of the first capacitor and the first electrode of the CMUT, wherein a resonant frequency of the inductor and the CMUT is between 0.1 Fc and 5 Fc, where Fc is a center frequency of the CMUT.

11. The system as recited in claim 1, wherein the system comprises a plurality of the CMUTs, a plurality of the first capacitors, and a plurality of the first resistors, each CMUT having:

a respective one of the first capacitors having a respective first electrode electrically connected to a respective first electrode of a respective CMUT, and a respective second electrode of the respective first capacitor electrically connected to a respective channel of the TX/RX circuit; and a respective one of the first resistors having a respective first electrode electrically connected to the respective first electrode of the respective first capacitor and a respective second electrode of the respective CMUT, and a respective second electrode of the respective first resistor electrically connected to at least one of the ground or common return path;

wherein the first electrode of the second capacitor is electrically connected to each of the respective second electrodes of the respective CMUTs, the second electrode of the second capacitor being electrically connected to at least one of the ground or common return path.

12. The system as recited in claim 11, further comprising a second resistor having a first electrode electrically connected to the respective second electrodes of the respective CMUTs and the first electrode of the second capacitor, the second resistor having a second electrode electrically connected to the bias voltage supply.

13. The system as recited in claim 11, further comprising a respective third capacitor and a respective third resistor associated with each respective CMUT, wherein:

the respective third capacitor associated with each respective CMUT includes a respective first electrode electrically connected to the respective second electrode of the respective first capacitor, the respective third capacitor having a respective second electrode electrically connected to the respective channel of the TX/RX circuit; and the respective third resistor associated with each respective CMUT includes a respective first electrode electrically connected to the first electrode of the respective third capacitor and the respective second electrode of the first capacitor, the respective third resistor having a respective second electrode electrically connected to at least one of the ground or common return path.

14. The system as recited in claim 11, further comprising a probe handle connected to a connector by one or more conductors, wherein:

the plurality of first capacitors and the plurality of first resistors are disposed in the connector, and the plurality of CMUTS is disposed in the probe handle.

15. A probe system comprising:

a probe handle;

a connector;

one or more conductors connecting the connector to the probe handle;

a capacitive micromachined ultrasonic transducer (CMUT) disposed in the probe handle, the CMUT including a first electrode and a second electrode separated by a transducing gap;

a first capacitor disposed in the connector, the first capacitor having a first electrode electrically connected to the first electrode of the CMUT, the first capacitor having a second electrode to electrically connect to a transmit and/or receive (TX/RX) circuit; and a first resistor disposed in the connector, the first resistor having a first electrode electrically connected to the first electrode of the first capacitor and the first electrode of the CMUT, the first resistor having a second electrode electrically connected to at least one of:

a ground or common return path; or the second electrode of the first capacitor, wherein there are a plurality of the CMUTs disposed in the probe handle, and a plurality of the first capacitors and a plurality of the first resistors disposed in the connector, wherein each CMUT has associated therewith: a respective one of the first capacitors having a respective first electrode electrically connected to the respective first electrode of the respective CMUT, and a respective second electrode electrically connected for connection to a respective channel of the TX/RX circuit; and a respective one of the first resistors having the respective first electrode electrically connected to the respective first electrode of the respective first capacitor and the respective second electrode of the respective CMUT, and the respective second electrode electrically connected to the ground or common return path.

16. The probe system as recited in claim 15, further comprising a bias voltage supply for supplying a bias voltage to the second electrode of the CMUT.

17. The probe system as recited in claim 15, wherein:

a capacitance of the first capacitor is 5 times or more larger than a capacitance of the CMUT, and a resistance of the first resistor is 5 times or more larger than an impedance of the CMUT in an operating frequency range of the CMUT.

18. The probe system as recited in claim 15, further comprising a second capacitor, wherein the second capacitor includes a first electrode electrically connected to the second electrode of the CMUT, the second capacitor including a second electrode electrically connected to at least one of the ground or common return path.

19. The probe system as recited in claim 18, further comprising a second resistor, wherein the second resistor includes a first electrode electrically connected to the first electrode of the second capacitor and the second electrode of the CMUT, the second resistor including a second electrode to electrically connect to a bias voltage supply.

20. The probe system as recited in claim 19, wherein:

a capacitance of the second capacitor is 5 times or more larger than a capacitance of the CMUT, a resistance of the second resistor is 1/10 to 1/3 a resistance of the first resistor, and an impedance of the second resistor is 5 times or more larger than an impedance of the second capacitor in a CMUT operating frequency range.

21. The probe system as recited in claim 15, further comprising a second capacitor, wherein the second capacitor includes a first electrode electrically connected to the second electrode of each of the CMUTs and a second electrode electrically connected to at least one of the ground or common return path.

22. The probe system as recited in claim 15, further comprising an inductor disposed in the probe handle, the inductor electrically connected between the first electrode of the first capacitor and the first electrode of the CMUT, wherein a resonant frequency of the inductor and the CMUT is between 0.1 Fc and 5 Fc, where Fc is a center frequency of the CMUT.

23. A system comprising:

a capacitive micromachined ultrasonic transducer (CMUT) including a first electrode and a second electrode, wherein the second electrode is opposed to the first electrode;

a bias voltage supply for supplying a bias voltage to the second electrode;

a transmit and/or receive (TX/RX) circuit;

a first capacitor having a first electrode electrically connected to the first electrode of the CMUT, the first capacitor having a second electrode electrically connected to the TX/RX circuit, the first capacitor having a capacitance that is 5 times or more larger than a capacitance of the CMUT; and a first resistor having a first electrode electrically connected to the first electrode of the first capacitor and the first electrode of the CMUT, the first resistor having a second electrode electrically connected to at least one of:

a ground or common return path; or the second electrode of the first capacitor.

24. The system as recited in claim 23, wherein a resistance of the first resistor is 5 times or more larger than an impedance of the CMUT in an operating frequency range of the CMUT.

25. The system as recited in claim 23, further comprising a second capacitor having a first electrode electrically connected to the second electrode of the CMUT, the second capacitor having a second electrode electrically connected to at least one of the ground or common return path.

26. The system as recited in claim 25, wherein a capacitance of the second capacitor is 5 times or more larger than a capacitance of the CMUT.

27. The system as recited in claim 25, further comprising a second resistor having a first electrode electrically connected to the first electrode of the second capacitor and the second electrode of the CMUT, the second resistor having a second electrode electrically connected to the bias voltage supply, wherein:

a resistance of the second resistor is 1/10 to 1/3 a resistance of the first resistor, and/or an impedance of the second resistor is 5 times or more larger than an impedance of the second capacitor in a CMUT operating frequency range.

* * * * *